US007748308B2

(12) United States Patent
Anderson et al.

(10) Patent No.: US 7,748,308 B2
(45) Date of Patent: Jul. 6, 2010

(54) PNEUMATIC BIASING OF A LINEAR ACTUATOR AND IMPLEMENTATIONS THEREOF

(75) Inventors: Robb G. Anderson, Racine, WI (US); James P. McCrickard, Racine, WI (US); Thomas L. Beck, Union Grove, WI (US)

(73) Assignee: Unico, Inc., Franksville, WI (US)

( * ) Notice: Subject to any disclaimer, the term of this patent is extended or adjusted under 35 U.S.C. 154(b) by 923 days.

(21) Appl. No.: 11/526,362

(22) Filed: Sep. 25, 2006

(65) Prior Publication Data

US 2007/0068399 A1 Mar. 29, 2007

Related U.S. Application Data

(60) Provisional application No. 60/720,592, filed on Sep. 26, 2005.

(51) Int. Cl.
*F01B 13/00* (2006.01)
*F01B 9/00* (2006.01)

(52) U.S. Cl. ..... 91/61; 91/451; 74/89.36; 72/30.1; 72/454; 92/136

(58) Field of Classification Search ..... 310/20, 310/80; 74/89.15, 89.23, 89.25, 89.36, 89.38; 91/61, 136, 451, 452; 92/136; 72/30, 454; 100/270, 289
See application file for complete search history.

(56) References Cited

U.S. PATENT DOCUMENTS 3,203,257 A 8/1965 Geyer
4,181,003 A * 1/1980 Kononov et al. ..... 72/454
4,207,763 A * 6/1980 Huydts et al. ..... 72/454
4,590,787 A * 5/1986 Trimborn ..... 72/454
4,606,217 A * 8/1986 Schiller et al. ..... 72/454
4,782,258 A 11/1988 Petrosky
4,807,518 A 2/1989 Berchtold et al.
4,867,000 A * 9/1989 Lentz ..... 74/89.34
5,435,166 A 7/1995 Sunada
5,522,713 A 6/1996 Lian
5,557,154 A 9/1996 Erhart
5,577,433 A * 11/1996 Henry ..... 91/61

(Continued)

OTHER PUBLICATIONS

EXLAR Roller Screw Basics; website http://www.exlar.com/TI_ref_rollScrew_oview.html; date last visited Sep. 22, 2006; 2 pages.

(Continued)

*Primary Examiner*—David B Jones
(74) *Attorney, Agent, or Firm*—Reinhart Boerner Van Deuren P.C.

(57) ABSTRACT

An improved method and apparatus are provided for constructing and operating a linear actuator, and equipment incorporating a linear actuator, by operatively connecting a pressure biasing pneumatic arrangement between the driving member and the driven member of a mechanical linear actuator for applying a unidirectional biasing force between the driving and driven members, along an axis of motion, regardless of the location or movement of the driving and driven elements with respect to one another along the axis of motion. The pneumatic biasing arrangement is also configured, connected and operated to reduce the force which must be exerted by the driving and driven members in extending and retracting the linear actuator. The pneumatic biasing arrangement may further be configured for preferentially aiding extension or retraction of the actuator.

18 Claims, 13 Drawing Sheets

U.S. PATENT DOCUMENTS

| | | | | |
|---|---|---|---|---|
| 5,656,903 | A | 8/1997 | Shui et al. | |
| 5,806,402 | A * | 9/1998 | Henry | 91/61 |
| 5,809,837 | A | 9/1998 | Shaffer | |
| 6,041,597 | A | 3/2000 | Huang | |
| 6,116,139 | A | 9/2000 | Yuda, Jr. et al. | |
| 6,357,100 | B2 | 3/2002 | Speller, Jr. et al. | |
| 6,615,712 | B2 | 9/2003 | Faitel et al. | |
| 6,619,147 | B1 * | 9/2003 | Kojima | 74/89.36 |
| 6,640,601 | B2 | 11/2003 | Hatty | |
| 6,756,707 | B2 * | 6/2004 | Hochhalter et al. | 310/20 |
| 2002/0096060 | A1 | 7/2002 | Kohno | |
| 2005/0081660 | A1 | 4/2005 | Migliori | |
| 2006/0070222 | A1 | 4/2006 | Clew | |
| 2006/0090656 | A1 | 5/2006 | Iwashita et al. | |

OTHER PUBLICATIONS

EXLAR PRS Series Roller Screw Overview; website http://www.exlar.com/prod_PRS_oview.html; date last visited Sep. 22, 2006; 3 pages.

International Search Report and Written Opinion; International Applications No. PCT/US2006/037242; date of actual completion of the international search Feb. 23, 2007; date of actual mailing of the international search report Aug. 15, 2007; pages.

* cited by examiner

PNEUMATIC BIASING OF A LINEAR ACTUATOR AND IMPLEMENTATIONS THEREOF

CROSS-REFERENCE TO RELATED PATENT APPLICATIONS

This patent claims the benefit of U.S. Provisional Patent Application No. 60/720,592, filed Sep. 26, 2005, the disclosure of which is incorporated herein in its entirety by reference.

FIELD OF THE INVENTION

This invention relates to linear actuators, and more particularly to mechanical linear actuators, suitable for use in machinery such as metal forming presses, shears, brakes, and die cushions.

BACKGROUND OF THE INVENTION

Modem manufacturing practices often require machinery including linear actuators, for cutting, forming, punching, and/or joining together components formed from raw materials in a variety of forms, such as sheets, bar stock, billets, or pellet. Such machinery is often required to apply substantial compression loads, of, for example, 75 to 100 tons, and be capable of rapid cycle times, to promote efficient, effective, low cost production.

High capacity machinery, of the type used in cutting and forming motor vehicle body panels and the like, for example, typically have first and second structures in the form of upper and lower platens, each carrying part of a die set. The upper platen and upper die are typically driven vertically in a reciprocating motion by a drive mechanism including some form of linear actuator. The lower platen and lower die are generally stationary, but in some widely used types of metal forming machinery, a die cushion mechanism may be provided, adjacent the lower platen, for clamping an outer perimeter of a sheet of material being formed by the die set. Such die cushion mechanisms may also include a plurality of linear actuators for maintaining the clamping pressure on the edges of the work piece, as the work piece moves vertically during formation by the die set.

In the past, linear actuators of the type used in material forming machinery were primarily hydraulic and/or pneumatic actuators. Hydraulic and/or pneumatic actuators are typically capable of producing high operating forces at reasonably high cycle rates over a relatively long operating life of the machine. Hydraulic and/or pneumatic actuators are sometimes rather large in physical size, however, and require auxiliary equipment, such as pumps, valves, fluid tanks, and fluid cooling devices, which also are rather large in physical size. Hydraulic actuators often require considerable maintenance, and are prone to leakage over the operational life of the machine. Pneumatic actuators typically are incapable of being controlled, to the degree required for modern die press operations.

As material forming methods have become more sophisticated, mechanically driven actuators, having mechanisms such as ball screws, roller screws, or rack-and-pinion arrangements, for example, have begun to supplant traditional hydraulic actuators. Such mechanical actuators are typically smaller in physical size, than a corresponding hydraulic actuator, and may be capable of more rapid response and have greater controllability than hydraulic actuators. Mechanical actuators also eliminate the problem of fluid leakage inherent in the use of hydraulic actuators. U.S. Patent publications disclosing mechanical actuators for use in material forming machinery include: U.S. Pat. No. 5,522,713, to Lian; U.S. Pat. No. 5,435,166, to Sunada; U.S. Pat. No. 6,640,601 B2, to Hatty; U.S. Pat. No 5,656,903, to Shui, et al.; and US 2006/0090656 A1, to Iwashita, et al.

In a sophisticated die cushion apparatus, for example, a plurality of linear actuators may be closely positioned to one another around the perimeter of the workpiece. As the workpiece is formed, the clamping pressure applied by individual ones of the linear actuators may be varied, by a numerical control apparatus for example, to allow movement of material in selected sections of the periphery to preclude tearing or wrinkling of the workpiece during the forming process. To allow for such close positioning of the linear actuators, the individual actuators must be small in physical size. It is also desirable, that if one of the plurality of linear actuators should need to be repaired or replaced, that the individual linear actuators be modular in nature to facilitate removal and replacement of the defective actuator so that production on the material forming machine having the die cushion may be resumed as quickly as possible. It would be desirable to use mechanical actuators in such applications, rather than hydraulic actuators, due to the smaller size and more inherently modular construction of mechanical actuators, compared to hydraulic actuators.

Despite their significant inherent advantages, in a number of respects, over hydraulic actuators, the use of mechanical actuators in material forming machinery has been limited to date, due to wear and fatigue failure of the mechanical components of the mechanical actuator resulting from the large forces and cyclical loading on the mechanical components, inherent with the use of linear actuators in material forming machinery.

It is desirable, therefore, to provide improved apparatuses and methods for utilizing mechanically driven linear actuators in material forming machinery, in a manner which overcomes the problems addressed above. It is also desirable to provide such improved apparatuses and methods in a form which may be readily adapted for use as a primary linear actuator, in a platen press or a metal cutting shear, for example, and in applications, such as a die cushion mechanism, having a plurality of linear actuators performing a secondary clamping function in conjunction with one or more primary linear actuators providing a primary force for a material forming operation. It is further desirable, that such an improved apparatus and method also be in a form which is readily controllable and/or reconfigurable so that a given material forming machine may be conveniently used for a variety of operations, and/or with die sets, for example, of varying sizes and weights.

BRIEF SUMMARY OF THE INVENTION

The invention provides an improved method and apparatus for constructing and operating a linear actuator, or equipment incorporating a linear actuator, by operatively connecting a pressure biasing pneumatic arrangement between the driving member and the driven member of a mechanical linear actuator for applying a unidirectional biasing force between the driving and driven members, along an axis of motion, regardless of the location or movement of the driving and driven elements with respect to one another along the axis of motion.

Practice of the invention thereby precludes, reversal in the direction of forces at the juncture of the driving and driven member of the linear actuator as the linear actuator exerts a bi-directional force along the axis of motion between a first structure and a second structure. By virtue of this arrangement, backlash within the mechanical actuator can be substantially eliminated, with an attendant significant improvement in operation and reliability of the mechanical linear actuator.

In some forms of the invention, the pneumatic biasing arrangement is also configured to support substantially all of an operating load acting on the actuator, thereby substantially reducing operating loads imposed on the driving and driven members and also substantially reducing the level of operating force which must be exerted by the driving and driven members during operation of the mechanical linear actuator. The pneumatic biasing arrangement may further be configured, in some forms of the invention, to preferentially aid movement of the driven member in one direction, to thereby further reduce the level of operating force which must be exerted by the driving and driven members during movement of driving member in the preferred direction.

In some forms of a pneumatically biasable mechanical linear actuator, according to the invention, the driving and driven members, and the first and second cylinder elements are all coaxially disposed along the axis of motion, to thereby promote efficient and effective transfer of loads and forces within and applied by the actuator, and also to thereby provide a robust actuator of compact physical size and elegantly simple construction and operation. Such an actuator offers significant advantages over prior actuators including, but not limited to: improved operational performance, efficiency and effectiveness; enhanced reliability and life; reduced need for peripheral support equipment; modular installation and replacement; and the capability to fit multiple actuators into smaller spaces.

A pneumatically biasable linear actuator apparatus, according to the invention, may also include a control arrangement operatively connected to the pneumatic biasing arrangement for controlling the unidirectional biasing force. Such a control arrangement may take the form of a simple pressurizing source and valve arrangement, or any other appropriate form, including a numerically controlled apparatus for actively controlling the pneumatic biasing arrangement during operation of the mechanical linear actuator.

In one form of the invention, a pneumatically biasable mechanical linear actuator apparatus is provided, for exerting a bi-directional force along an axis of motion between a first structure and a second structure, wherein at least one of the structures is movable along the axis of motion. The linear actuator apparatus includes at least one pneumatically biasable linear actuator having a driving and a driven member, and a pneumatic biasing arrangement. The driving and driven members are connected to one another in a mechanical drive arrangement for motion relative to one another along the axis of motion. The pneumatic biasing arrangement is operatively connected between the driving member and the driven member for applying a unidirectional biasing force between the driving and driven members, along the axis of motion, regardless of the location or movement of the driving and driven elements with respect to one another along the axis of motion.

The driving and driven members may apply an operating force to the first and second structures, with the pneumatic biasing arrangement maintaining the unidirectional biasing force between the driving and driven members regardless of the direction or level of operating force on the first and second structures, and regardless of relative position or motion of the first and second structures with respect to one another.

One form of a pneumatic biasing arrangement, according to the invention, includes first and second pneumatic cylinder elements which are connected to one another for reciprocal movement with respect to one another along the axis of motion. The first and second cylinder elements collectively define a fluid cavity therebetween, with the cavity defining a volume for receiving a pressurized fluid. The first cylinder element is fixedly attached to the driving element, for movement therewith along the axis of motion, and the second cylinder element is fixedly attached to the driven member for movement therewith, such that relative movement of the driven and driving members, with respect to one another, in one direction along the axis of motion, causes an increase in the volume of the cavity, and movement of the driven and driving elements, with respect to one another in an opposite direction along the axis of motion, causes a decrease in the volume of the cavity.

A volume adjusting element may be movably disposed within the fluid cavity for modifying the volume of the cavity available for receiving pressurized fluid in the cavity. The volume control arrangement may also be configured for performing other functions, such as, but not limited to: adjusting the relationship between the stroke length, and/or stoke direction, of the linear actuator, and the change in pressure within the cavity resulting from the stroke; adjusting the axial length of the linear actuator; setting maximum and/or minimum operating pressures for the pressurized gas within the cavity; and/or, setting a desired maximum or minimum magnitude of the unidirectional biasing force.

In some forms of the invention, the unidirectional biasing force varies in magnitude, throughout the stroke of the linear actuator.

In some forms of the invention, the pneumatic biasing arrangement, of a pneumatically biasable mechanical linear actuator, according to the invention, may be operated without applying a biasing force between the driving and driven members of the mechanical drive arrangement. The pneumatic biasing arrangement may be configured and operated to apply an offset force, for supporting some portion, or substantially all of an operating load acting on the actuator, substantially without applying a biasing force between the driving and driven members of a pneumatically biasable mechanical linear actuator, according to the invention, to thereby at least partially reduce operating loads imposed on the driving and driven members and also at least partially reduce the level of operating force which must be exerted by the driving and driven members during operation of the mechanical linear actuator.

A control arrangement may be provided for controlling the amount of pressurized gas in the volume. The control arrangement may adjust the amount of pressurized gas in the volume to maintain a desired level of unidirectional biasing force, during operation of the linear actuator. The volume adjusting element may also function as a linear length adjustment arrangement for adjusting a minimum linear maximum length of the actuator.

Some forms of the invention may utilize two or more pneumatically biasable mechanical linear actuators, according to the invention. A common control arrangement may be utilized for controlling the amount of pressurized gas in the volumes of each of the two or more linear actuators.

In some forms of the invention, a pneumatically biasable mechanical linear actuator, according to the invention, may be operated with, or without, an amount of pressurized gas being disposed within the volume of the pneumatic biasing arrangement. An amount of pressurized gas, sufficient for generating the unidirectional biasing force between the driving and driven members, may be disposed within the volume of the pneumatic biasing arrangement. Where application of driving force to the driving member generates a driving force in the driven member, the amount of pressurized gas may be controlled to generate sufficient pressure within the cavity for maintaining the unidirectional biasing force between the driving and driven members regardless of the direction or level of the driving force. Where the first and second structures apply an operating load to the actuator, the amount of pressurized gas in the cavity may generate sufficient pressure within the cavity for maintaining the unidirectional biasing force between the driving and driven members regardless of the direction or level of the operating load on the actuator, and regardless of relative position or motion of the first and second structures with respect to one another.

The driving and driven members, respectively, may be a rotatable screw member and a roller nut member of a roller screw apparatus, with the screw having a rotational center line thereof substantially defining the axis of motion and first and second axial ends thereof spaced axially from one another along the axis of motion. The roller nut member may have rotating inner members for engaging the screw, with the rotating inner members being operatively attached to and disposed within a non-rotating roller screw housing. The first cylinder element of the pneumatic biasing arrangement may be substantially symmetrically disposed about the axis of motion and may have the screw member operatively attached thereto in a manner allowing rotation of the screw with respect to the first cylinder element, about the axis of rotation, while axially restraining the screw against axial movement of the screw with respect to the first cylinder element. The first cylinder element may further have first and second axial ends thereof, with the first axial end of the first cylinder element being disposed adjacent the first axial end of the screw and the second axial end of the first cylinder element being disposed adjacent the second axial end of the screw. The second axial end of the screw is configured as a closed surface, to form a stationary piston having an outer sealing periphery thereof.

The second cylindrical element, in the form of an axially movable cylinder, may have a wall thereof sealingly and slidingly engaging the sealing periphery of the stationary piston of the first cylinder member in such a manner that the wall of the movable cylinder, in conjunction with the stationary piston of the first cylinder member, form the cavity and define the volume within the cavity for receiving the pressurized gas. The second cylindrical element, in the form of the axially movable cylinder, is operatively attached to the first cylindrical element in a manner allowing the second cylindrical element to move axially with respect to the first cylinder element, but not rotate with respect to the first cylindrical element or the axis of motion. The second cylindrical element, in the form of the axially movable cylinder, also has first and second axial ends thereof, with the first axial end overlapping the first cylinder member and having the roller screw housing fixedly attached thereto in such a manner that the roller screw nut moves axially with the movable cylinder. The second axial end of the movable cylinder is closed by the wall thereof.

The first cylindrical element is adapted for operatively bearing against a stationary one of the first and second structures, and the second cylindrical element is adapted for operatively bearing against the movable one of the first and second structures.

A guide, extending from the first cylindrical element along the axis of motion and disposed about a portion of the second cylindrical member, may be included, for guiding and supporting the second cylindrical element axially about the axis of motion.

A drive motor may be operatively attached to the first end of the screw for rotating the screw about the axis of rotation. The motor may have a drive shaft thereof attached directly to the first end of the screw, for driving the screw, in such a manner that the motor, screw, roller nut member, and the first and second cylindrical elements are all substantially coaxial about the axis of motion. A brake may also be provided for selectively restraining the screw from rotating about the axis of rotation.

In some forms of the invention, the axis of motion is oriented substantially vertically. In some forms of the invention, the first end of the first cylindrical element may be attached to a stationary base of a material forming machine, with the second end of the second cylindrical element being disposed substantially vertically above the first end of the first cylindrical element.

The invention may also take the form of a method for pneumatically biasing a mechanical linear actuator apparatus for exerting a bi-directional force along an axis of motion between a first structure and a second structure, wherein at least one of the structures is movable along the axis of motion, and wherein the apparatus includes at least one pneumatically biasable linear actuator, according to the invention, having a driving and a driven member connected to one another in a mechanical drive arrangement for motion relative to one another along the axis of motion. The method may include operatively connecting a pneumatic biasing arrangement between the driving member and the driven member of the linear actuator, for applying a unidirectional biasing force between the driving and driven members, along the axis of motion, regardless of the location or movement of the driving and driven element with respect to one another along the axis of motion. The method may also include controlling the unidirectional biasing force to a desired value, using the pneumatic biasing arrangement. Where the driving and driven members apply an operating force to the first and second structures, a method, according to the invention, may further include operating the pneumatic biasing arrangement in a manner that maintains the unidirectional biasing force between the driving and driven members regardless of the direction or level of the operating force on the first and second structures, and regardless of the relative position or motion of the first and second structures with respect to one another.

The invention may also take the form of a material forming machine having a first and second structure, wherein at least one of the structures is movable along an axis of motion, and also having at least one pneumatically biasable linear actuator apparatus, according to the invention, operatively connecting the first and second structures for exerting a bi-directional force along the axis of motion between the first and second structures. The linear actuator may include a driving and a driven member connected to one another in a mechanical drive arrangement, for motion relative to one another along the axis of motion, and a pneumatic biasing arrangement operatively connected between the driving member and the driven member for applying a unidirectional biasing force between the driving and driven members, along the axis of motion, regardless of the location or movement of the driving and driven elements with respect to one another along the axis of motion.

A material forming machine, according to the invention, may take a variety of forms, including, but not limited to: a platen press; a shear; a brake; a press for operating a die set; a die cushion mechanism; a punch; an extrusion press; or a compaction press for use in forming components from pellets or chips of a material such as plastic, for example.

Other aspects, objects, and advantages of the invention will be apparent from the following detailed description and accompanying drawings describing exemplary embodiments of the invention.

DESCRIPTION OF THE DRAWINGS

The accompanying drawings incorporated into and forming part of the specification illustrate several aspects of the present invention and, together with the description, serve to disclose and explain the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
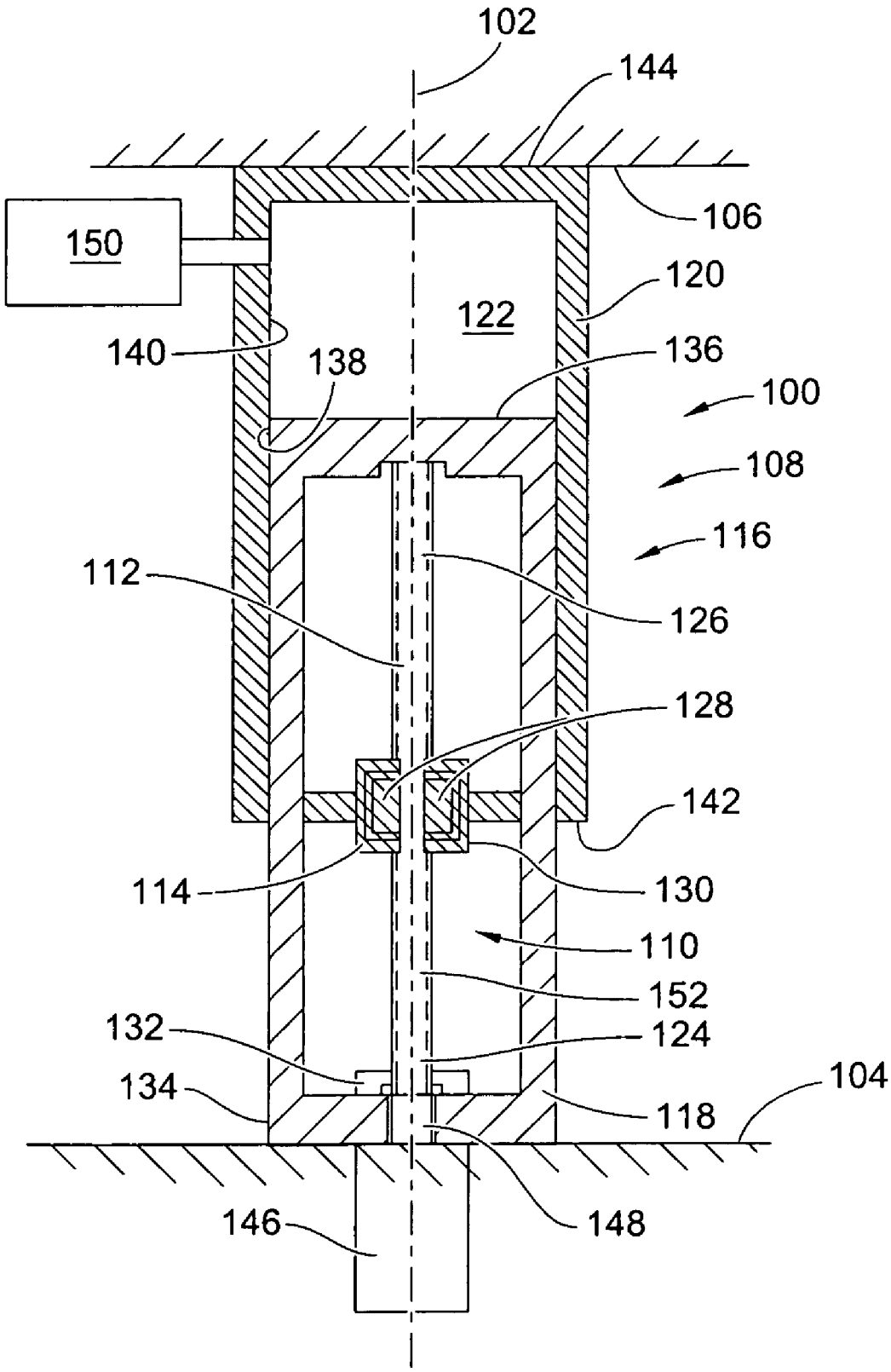
FIGS. 1-3 are schematic cross-sectional illustrations of a first exemplary embodiment of a pneumatically biasable mechanical linear actuator apparatus, according to the invention, with FIG. 1 showing a linear actuator, according to the invention, in an extended position, FIG. 2 showing the exemplary embodiment of the linear actuator in a retracted position, and FIG. 3 illustrating a variation of the first exemplary embodiment of a pneumatically biasable mechanical linear actuator apparatus, according to the invention, which includes two pneumatically biasable linear actuators in accordance with the invention.
Figure 2:
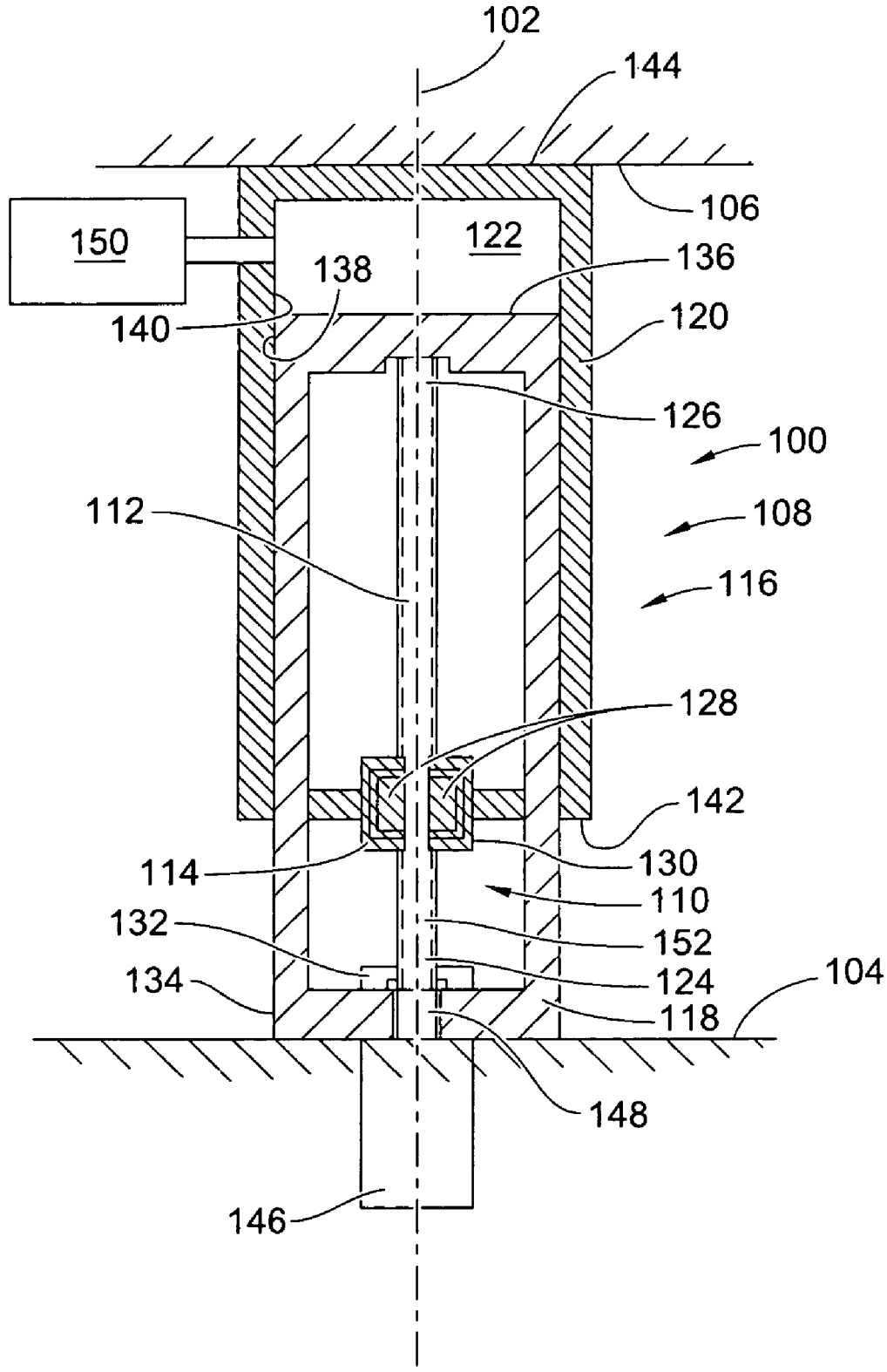
Figure 3:
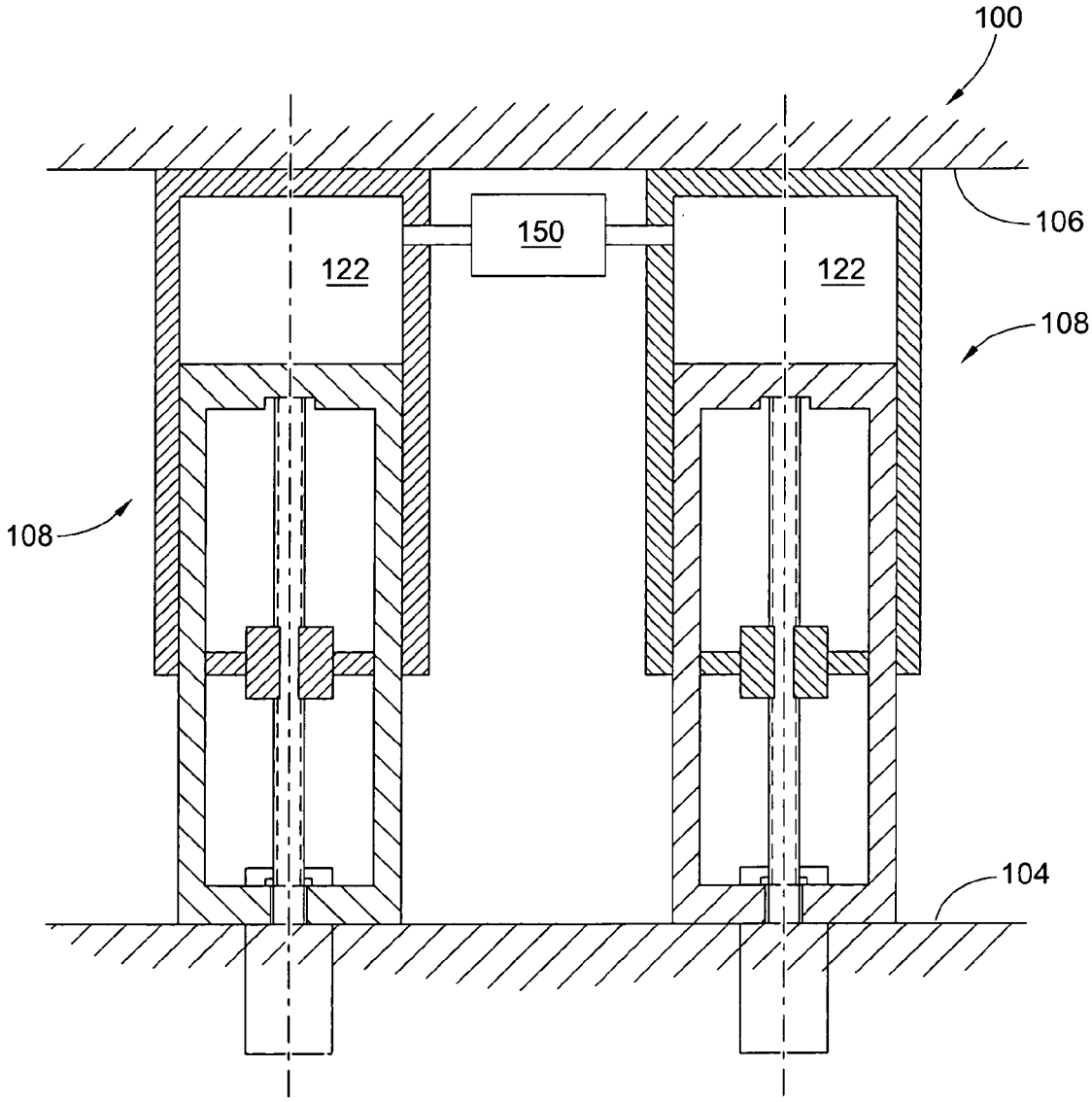

FIGS. 1-3 illustrate a first exemplary embodiment of a pneumatically biasable linear actuator apparatus 100, for exerting a bi-directional force along an axis of motion 102 between a first structure 104 and a second structure 106, wherein at least one of the structures 104, 106 is movable along the axis of motion 102. Specifically, in the exemplary embodiments illustrated in FIGS. 1-3, the first structure 104, represents a stationary base of a material forming machine, and the second structure 106 represents a movable bridge or platen of the material forming machine.

The first exemplary embodiment of the pneumatically biasable linear actuator 100 includes one or more pneumatically biasable mechanical linear actuators 108, each having a drive arrangement 110 including a driving member 112 and a driven member 114. Each of the pneumatically biasable mechanical linear actuators 108, of the first exemplary embodiment, also includes a pneumatic biasing arrangement 116 operatively connected between the driving member 112 and the driven member 114 of the drive arrangement 110. The driving and driven members 112, 114 are operatively connected to one another, within the mechanical drive arrangement 110, for motion relative to one another along the axis of motion 112. Specifically, in the first exemplary embodiment 100, the driven member 114 is moved linearly along the axis of motion 102 by the driving member 112.

As described in more detail below, the pneumatic biasing arrangement 116 is operatively connected between the driving member 112 and the driven member 114, for applying a unidirectional biasing force between the driving and driven members 112, 114 along the axis of motion 102, regardless of the location or movement of the driving and driven elements 112, 114 with respect to one another, along the axis of motion 102.

The pneumatic biasing arrangement 116, of the first exemplary embodiment 100, includes first and second cylinder elements 118, 120, which are connected to one another, for reciprocal movement with respect to one another along the axis of motion 102. The first and second cylinder elements 118, 120 are also configured for collectively defining a fluid cavity 122 between the first and second cylinder elements 118, 120, with the cavity 122 defining a volume for receiving a pressurized fluid.

The first cylinder element 118 is fixedly attached to the driving member 112. The second cylinder element 120 is fixedly attached to the driven member 114, for movement therewith along the axis of motion, such that relative movement of the driven and driving members 112, 114 with respect to one another in one direction along the axis of rotation causes an increase in the volume of the cavity 122, and movement of the driven and driving members with respect to one another in an opposite direction along the axis of rotation 102 causes a decrease in the volume of the cavity 122.

In the first exemplary embodiment 100, the driving and driven members 112, 114 are, respectively, a rotatable screw member 112 and a roller nut member 114 of a roller screw apparatus 110. The screw 112 has a rotational center line thereof which substantially defines the axis of motion 102, and first and second axial ends 124, 126 thereof spaced axially from one another along axis of motion 102. The roller nut member 114 includes a plurality of rotating intermembers 128, as is known in the art, for engaging the screw 112, with the rotating intermembers 128 being operatively attached to and disposed within a non-rotating roller screw housing 130.

Those having skill in the art, will recognize that the roller screw drive arrangement 110, of the exemplary embodiment 100, is of typical construction for such devices. A roller screw was selected for the drive arrangement 110 in the exemplary embodiment 100, because roller screw drive arrangements typically are capable of handling larger static loads at high screw speeds and offer longer life than comparably sized alternative drive mechanisms, such as ball screws. Roller screw drive arrangements, of a type suitable for practicing the invention are manufactured by SKF Motion Technologies, Bethlehem, Pa., USA. Those having skill in the art will recognize, however, that in alternate embodiments, the present invention may be practiced with a variety of other types of drive arrangements 110, including, but not limited to: ball screws, Acme screws; rack-and-pinion gear arrangements, etc.

The first cylinder element 118 of the pneumatic biasing arrangement 116 forms a first cylinder member 118 disposed about the axis of motion 102, and having the screw member 112 operatively attached thereto in a manner allowing rotation of the screw 112 with respect to the first cylinder member 118 about the axis of rotation 102, while axially restraining the screw 112 against axial movement of the screw 112 with respect to the first cylinder member 118. In the first exemplary embodiment 100, the axial restraint of the screw 112 to the first cylinder member 118 is illustrated by a thrust bearing 132 operatively connected between the screw 112 and the first cylinder member 118 at the first axial end 124 of the screw 112.

The first cylinder element, 118, in the exemplary embodiment 100, further has first and second axial ends 134, 136 thereof, with the first axial end 134 of the first cylinder member 118 being disposed adjacent to the first axial end 124 of the screw 112, and the second axial end 136 of the first cylinder member 118 being disposed adjacent the second axial end 126 of the screw 112. The second axial end 136 of the first cylinder member 118 is configured as a closed surface to form a stationary piston having an outer sealing periphery 138 thereof.

The second cylindrical element, in the form of an axially movable cylinder 120, has a wall 140 thereof which sealingly and slidingly engages the sealing periphery 138 of the stationary piston 136 of the first cylinder member 118, such that the wall 140 of the movable cylinder 120, in conjunction with the stationary piston 136 of the first cylinder member 118, form the cavity 122 and define the volume for receiving the pressurized gas. The movable cylinder 120 is operatively attached to the first cylinder member 118 in a manner allowing the axially movable cylinder 120 to move axially with respect to the first cylinder member 118, but not rotate with respect to either the first cylinder member 118 or the axis of motion 102.

The axially movable cylinder 120 also has first and second axial ends 142, 144 thereof. The first axial end 142, of the axially movable cylinder 120, overlaps the first cylinder member 118, and has the roller screw housing 130 attached thereto in such a manner that the roller screw nut 114 moves axially with the movable cylinder 120. The first cylinder member 118 and first axial end of the movable cylinder 120 are vented to the atmosphere, to preclude any build-up of pneumatic pressure below the piston 136 at the second axial end of the first cylinder member 118.

The second axial end 144 of the movable cylinder 120 is closed, to form a load bearing surface, and form part of the wall 140 and closing the cavity 122. The first axial end 134 of the first cylinder member 118 is adapted for operatively bearing against the stationary structure 104, and the second axial end 144 of the axially movable cylinder 120 is adapted for operatively bearing against the movable second structure 106.

The pneumatically biasable mechanical linear actuator 108, of the first exemplary embodiment 100, includes a drive motor 146, having a drive shaft 148 thereof attached to the first axial end 124 of the screw member 112, for rotating the screw member 112 about the axis of rotation substantially coincident with the axis of motion 102.

By virtue of the construction described thus far, it will be seen that, in the pneumatically biasable mechanical linear actuator apparatus 108 of the first exemplary embodiment 100, all of the components described thus far are coaxially located with respect to one another, along and about the axis of motion 102. This coaxial arrangement provides a highly compact and robust, straightforward, actuator construction, and promotes efficient and effective operation of the actuator 108.

The first exemplary embodiment of the pneumatically biasable mechanical linear actuator apparatus 100, also includes a control arrangement 150, operatively connected to the pneumatic biasing arrangement 116, for introducing and controlling an amount of pressurized gas into the volume of the cavity 122, to thereby control the level of unidirectional biasing force applied to the roller screw drive arrangement 110.

The control arrangement 150, illustrated schematically in FIGS. 1-3, may take a variety of forms in various embodiments of the invention. For example, in some forms of the invention, the control arrangement may consist simply of a closable valve allowing introduction of pressurized gas into, or removal of pressurized gas from the cavity 122, in embodiments of the invention in which the pressure of the gas in the cavity 122 is not actively controlled during operation of the actuator 108. In other forms of the invention, the control arrangement 150 may be considerably more sophisticated, and include components for monitoring pressure of the gas within the cavity 122, during operation of the actuator 108 and actively controlling the amount of gas in the cavity 122, to maintain a desired gas pressure within the cavity 122 for providing a desired level of unidirectional biasing force on the roller screw drive arrangement 110. It will be further understood, that a control arrangement 150, according to the invention, could include devices such as, but not limited to: control valves, accumulators, two or more tanks, operatively connected in fluid communication with the cavity 110, to provide a stepped, incremental change in the volume of the cavity 110 at selected points within the operating cycle of the actuator 108; and or other devices and arrangements as may be known or become known in the art.

The operational advantages of having the pneumatic biasing arrangement 116 provide a unidirectional biasing force on the drive arrangement 110 will now be described, with reference to FIGS. 1 and 2.

As a matter of background information, to facilitate understanding of the invention and the advantages provided thereby, those having skill in the art will readily recognize that reversals in load direction and/or the direction of operating force supplied by the drive arrangement of a linear actuator driving a material forming machine are inherent in the operation of material forming machinery. For example, the load force and operating force will be aligned in a first combination during a compression stroke of a die forming operation, and then the alignment will be reversed, as the die is retracted and the part is stripped from the die set after completion of the forming process.

With regard to the present invention, if the cavity 122 were left open to atmospheric pressure, an axially oriented operating load, applied to the actuator 108 by the first and second structures 104, 106, would be reacted totally across the juncture of the mating threaded faces of the inner members 128 of the roller screw nut 114 with the screw member 112. Also, where the motor 146 is operated first in one direction, and then in an opposite direction, for first extending the actuator 108, in the manner shown in FIG. 1, and then retracting the actuator 108, as shown in FIG. 2, the direction of an operating force generated by the drive arrangement 110 is also sequentially reversed, in such a manner that, even with zero backlash between working components of the drive arrangement 110, the operating force bears first against one mating face of the threads of the roller screw drive arrangement 110 during extension, and then bears against the opposite mating faces of the components of the roller screw drive arrangement 110 during retraction. Such a reversal in direction imposes an undesirable cyclic loading on the threads of the roller screw drive arrangement 110 each time a change in the direction of the operating load or operating force is encountered, during operation of the actuator 108, when no biasing force is being supplied by the pneumatic biasing arrangement 116.

The pneumatic biasing arrangement 116, of the present invention, provides a convenient mechanism for precluding the reversal of force across the drive arrangement 110. Through application of an appropriate amount of pressurized gas into the cavity 122, a unidirectional preload force is continuously applied across the drive arrangement 110 at a level which is sufficient to keep the driving and driven members 112, 114 unidirectionally bearing against one another regardless of the relative position of the driving and driven members 112, 114 with respect to one another, or the direction of movement of the driving and driven members 112, 114 with respect to one another along the axis of motion 102.

Simply stated, by introducing a sufficient amount of pressurized gas into the cavity 122 to generate an axially directed force, acting against the second axial end 136 of the first cylinder member 118, which is greater than the sum of the operating load, the operating force and any acceleration, action of the first and second cylindrical elements 118, 120 on the drive arrangement 110 will generate a unidirectional sustained tension force in the portion 152 of the screw member 112 extending between the thrust bearing 132 and the roller screw nut 114.

As a result of the construction of the actuator 108 as described above, an amount of pressurized gas sufficient to generate the unidirectional biasing force under all operating conditions of the actuator 108 will also result in the generation of axially directed pressure forces within the cavity 122 that are high enough to substantially completely react and support the operating loads imposed on the actuator 108 by the first and second structures, throughout the entirety of the extension and retraction range of the actuator 108. Stated another way, the operating load substantially "floats" on the pressurized gas in the cavity 122, in such a manner that the load that would otherwise have had to be transferred to and supported solely by the mechanical drive arrangement 110 is largely relieved.

In some embodiments of the invention, through judicious design of the various components of the pneumatically biasable mechanical linear actuator 108, a fixed pre-charge amount of pressurized gas may be introduced into and sealed within the cavity 122 to provide the desired level of unidirectional pneumatic biasing of the drive arrangement 110 under all operating conditions of the actuator 108. With such an arrangement, in the actuator 108, the amount of pressurized gas within the cavity 122 will have to be sufficient for supporting the operating load and providing a desired minimum level of unidirectional biasing force when the actuator 108 is fully extended, as shown in FIG. 1.

As the actuator 108 retracts from the fully extended position, the volume of the cavity 122 will be reduced, resulting in an increase in pressure within the cavity 122, with the pressure in the cavity 122 reaching a maximum value at the fully retracted position of the actuator 108. This increase in pressure within the cavity will increase the operating force that must be applied by the mechanical drive arrangement 110 for retracting the actuator 108.

As the actuator is extended, however, axially directed pressure forces generated by the increased pressure, generated and stored in the cavity 122 during retraction of the actuator 108, aids the mechanical drive arrangement 110 in extending the actuator 108, and thereby reduces the operating force that must be supplied by the mechanical drive arrangement 110 during extension of the actuator 108.

It will be noted, by those having skill in the art, that by virtue of the construction and orientation of the components and features of the first exemplary embodiment to the actuator 108, the pressure force and unidirectional biasing force preferentially aid the drive arrangement 110 during extension of the actuator 108. In other embodiments of the invention, an actuator, according to the invention, may be configured such that the pressure force and unidirectional biasing force preferentially aid the drive arrangement during retraction of the actuator.

In other embodiments of the invention, the control arrangement 150 may be utilized for continually monitoring and adjusting the amount of pressurized gas in the cavity 122 to maintain the desired unidirectional pneumatic biasing force over the entire operating range of the actuator 108. Through such active control, the pressure of the gas in the cavity 122 may be controlled in an advantageous manner to reduce the operating forces imposed on the drive arrangement 110 below the levels of operating forces required in embodiments of the invention having the cavity 122 vented to the atmosphere or having a fixed pre-charge of pressurized gas sealed within the cavity.

With either a sealed pre-charge of pressurized gas, or in embodiments where the amount of pressurized gas is actively controlled, it may be desirable and/or necessary, when the operating loads and/or operating forces are changed substantially for performing different material forming operations, to recalibrate the control perimeters utilized by the control arrangement 150, or add or remove some of the pressurized gas pre-charge from the cavity 122.

Figure 4:
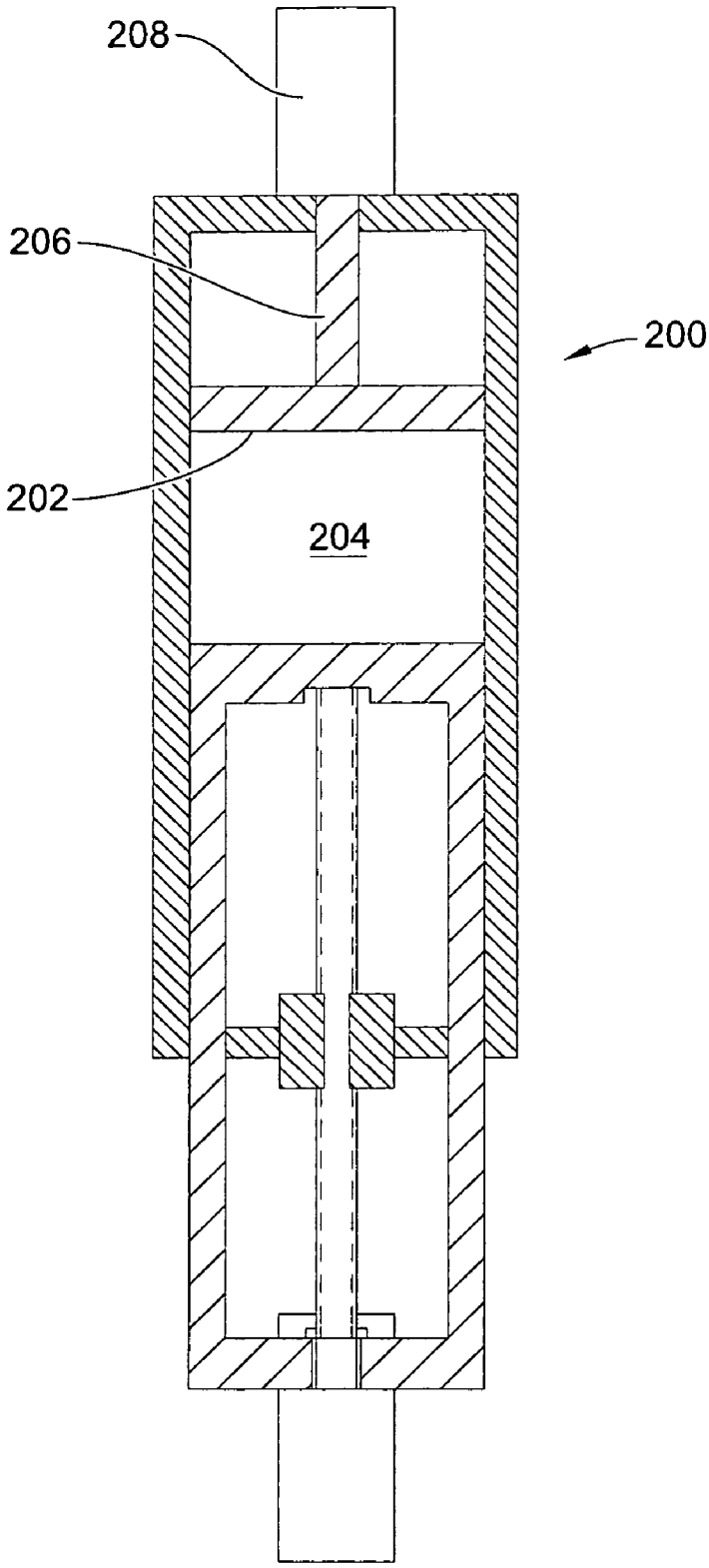
FIGS. 4-6 are schematic cross-sectional illustrations of a second exemplary embodiment of the invention, in the form of a pneumatically biasable mechanical linear actuator having a volume adjusting member disposed within a pressurized gas cavity of the actuator.
Figure 5:
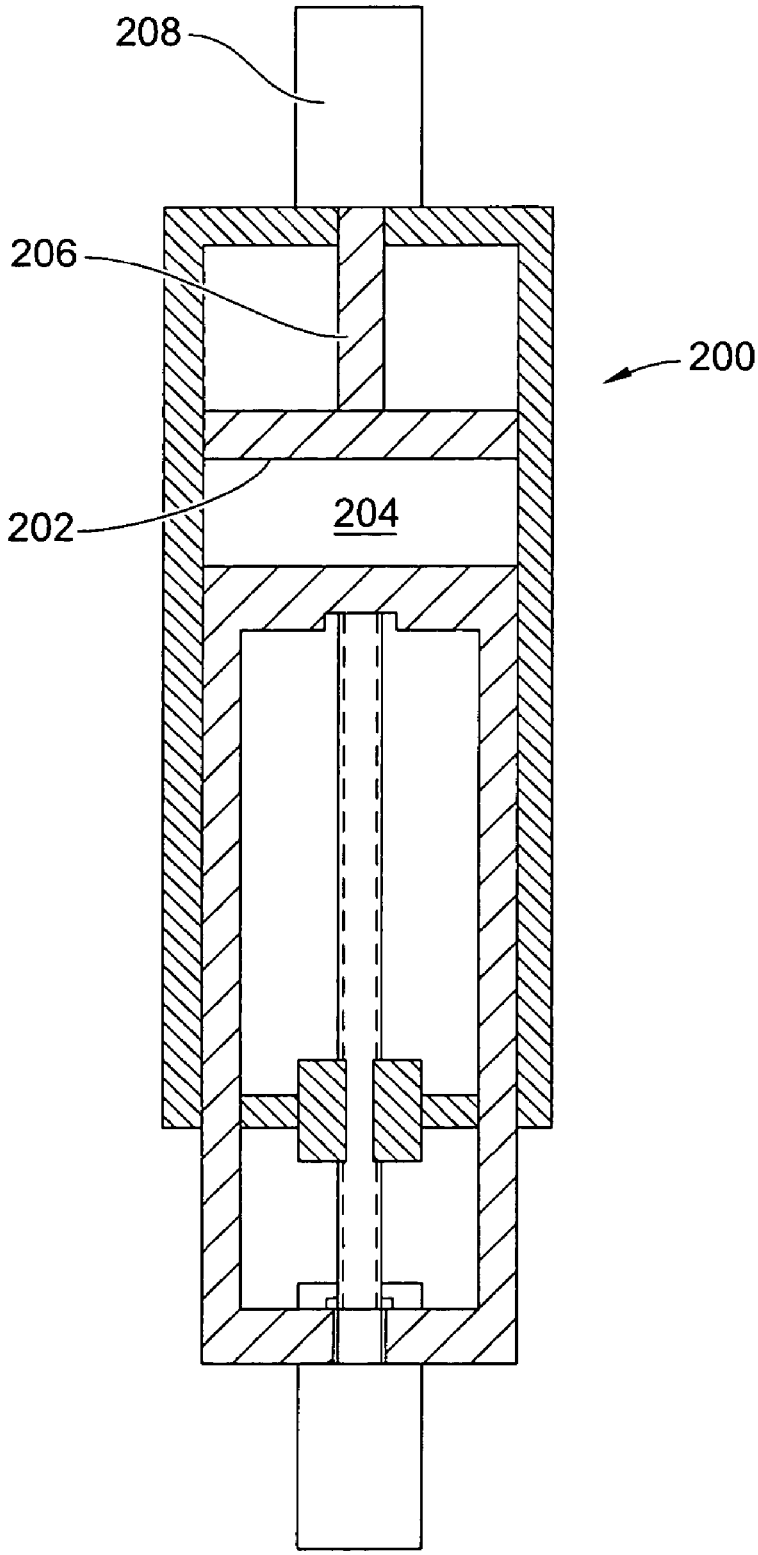
Figure 6:
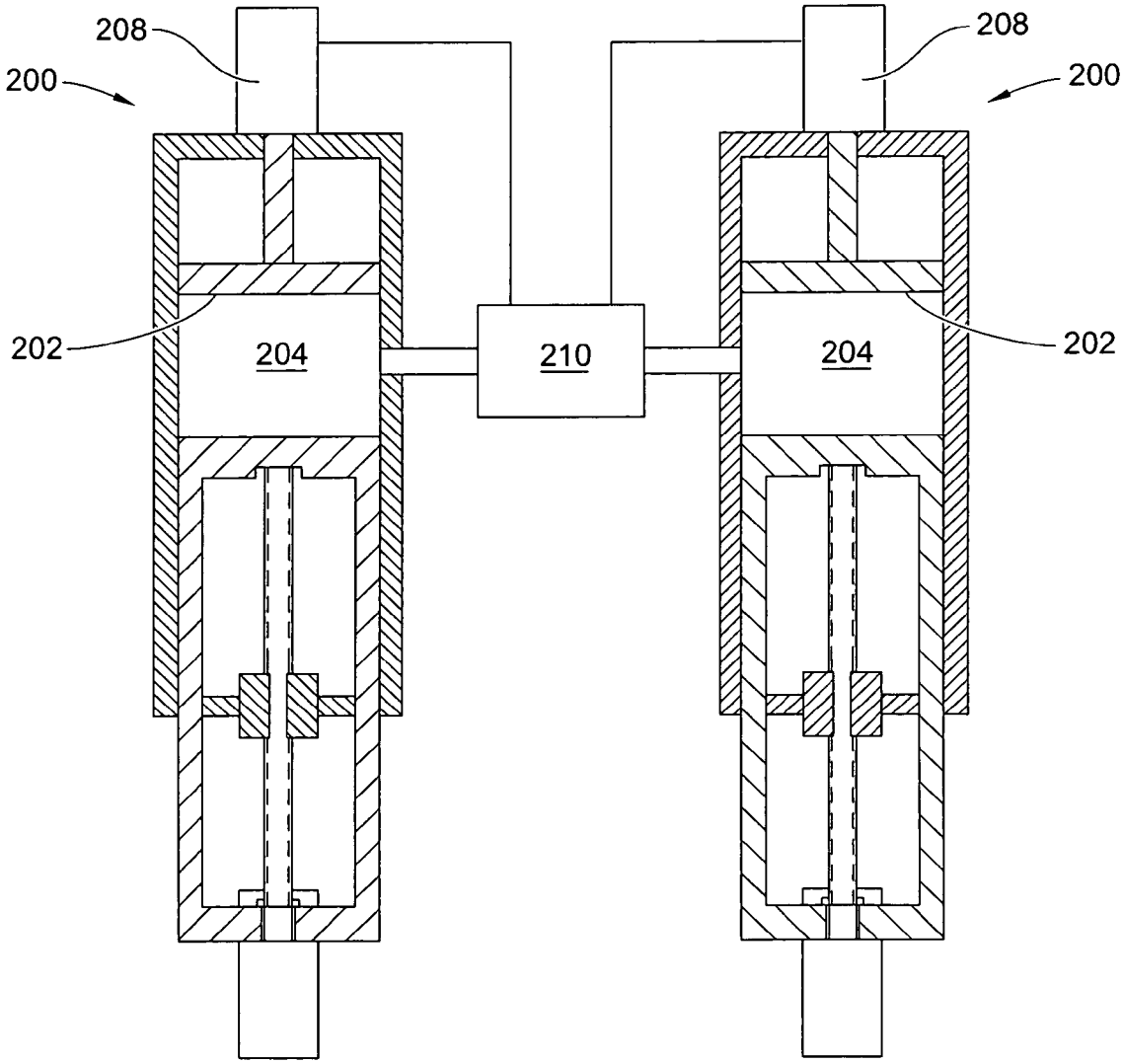

FIGS. 4-6 illustrate a second exemplary embodiment of a pneumatically biasable mechanical linear actuator 200, according to the invention, which is substantially similar to the first exemplary embodiment of a linear actuator 108, described above, except that the second exemplary embodiment 200 includes a cavity volume and actuator minimum length adjusting element, in the form of a movable piston 202, disposed within the fluid cavity 204 of the actuator 200 for modifying the volume of the cavity 204. The volume adjusting piston 202 is attached to an extensible element 206 of a volume adjusting actuator 208 for moving the piston 202 axially up or down (when the actuator 200 is oriented as shown in FIGS. 2 and 3) to provide an additional mechanism for conveniently adjusting the working volume of the cavity 204, and thereby facilitate set up and use of the second exemplary embodiment of the linear actuator 200, when the operating load and/or operating force conditions, or the operating stroke of the actuator 200 change significantly.

Figure 14:
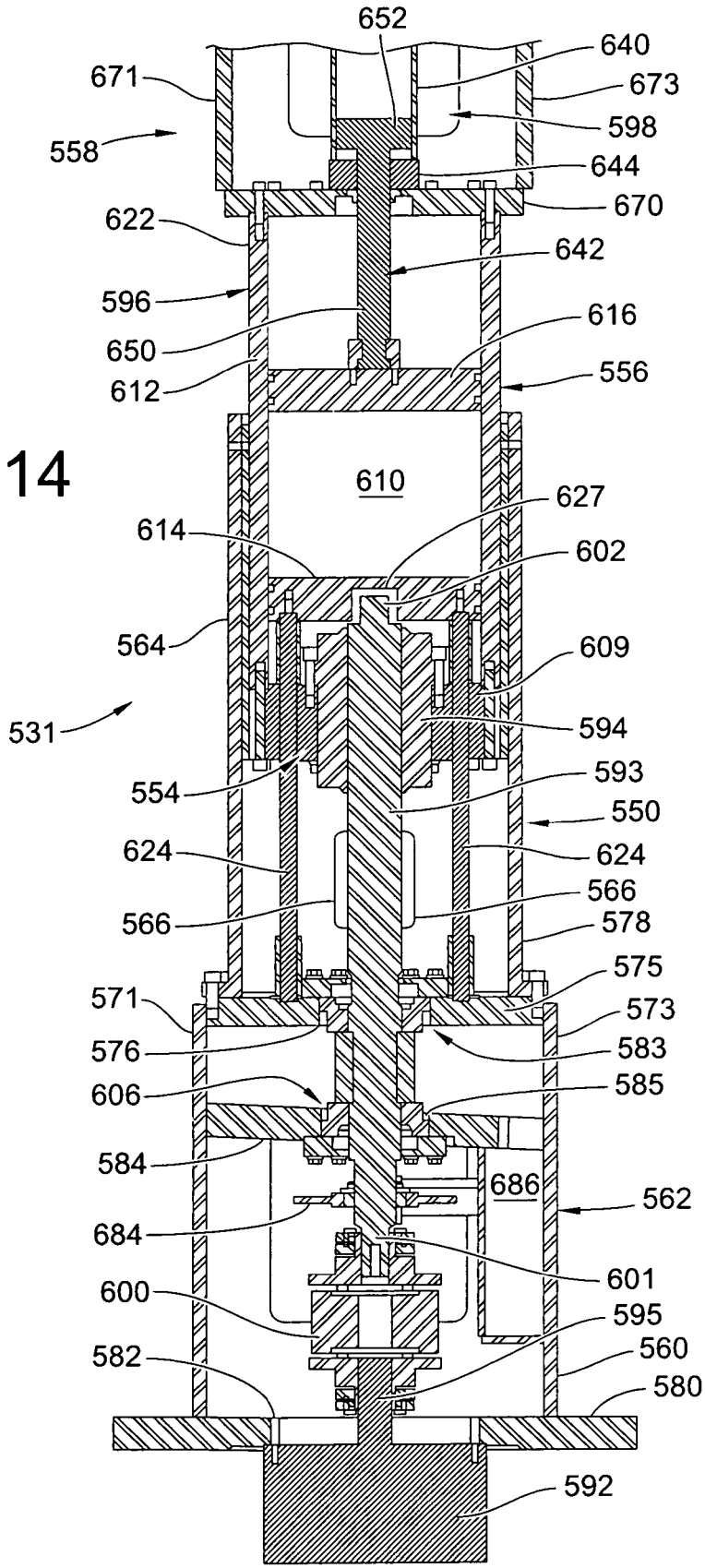
FIG. 14 is a cross-sectional illustration taken along lines 14-14 in FIG. 13, of the exemplary embodiment of the linear actuator shown in FIG. 12.
Figure 15:
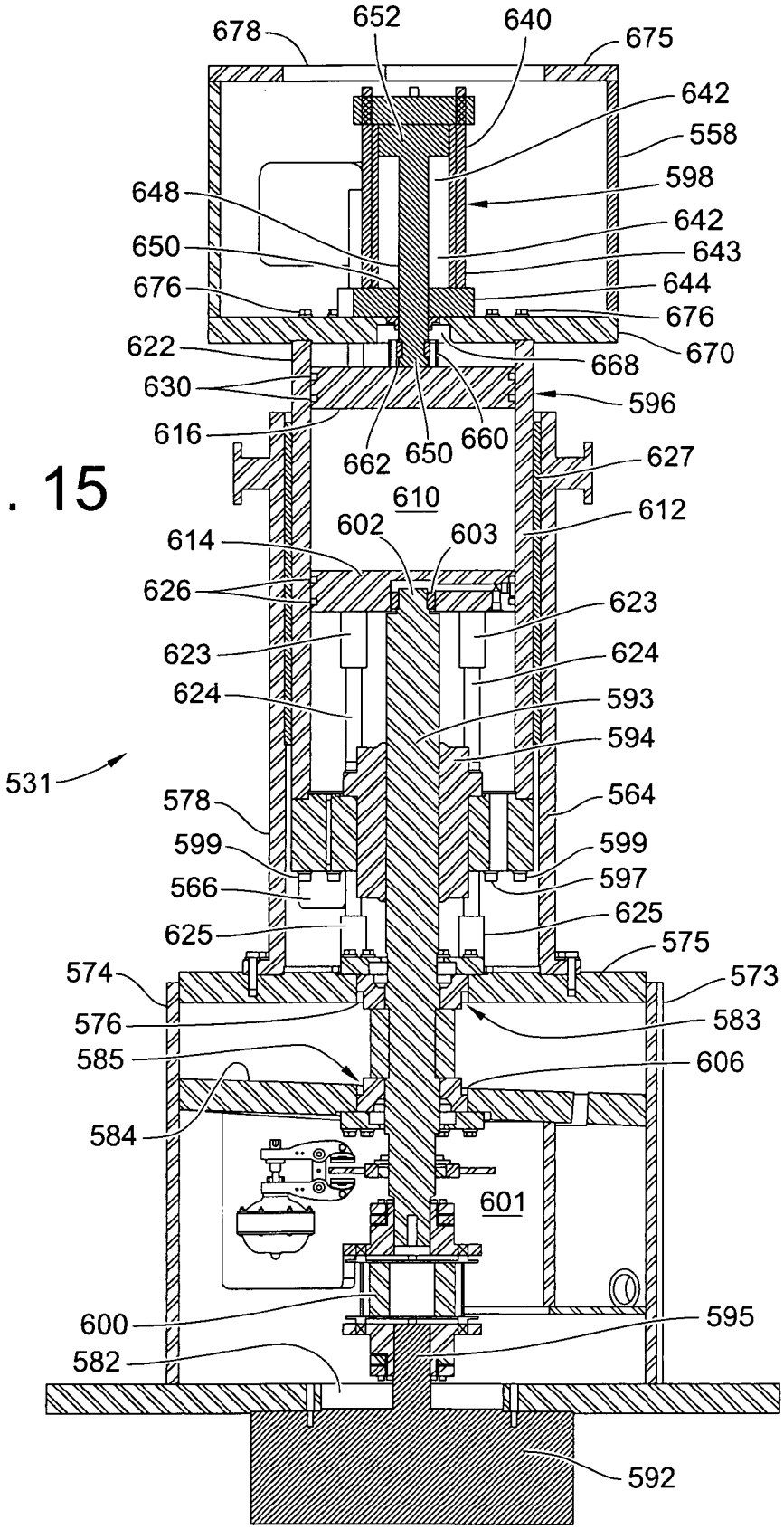
FIG. 15 is a cross-sectional illustration taken along lines 15-15 in FIG. 13, of the exemplary embodiment of the linear actuator shown in FIG. 12.
Figure 16:
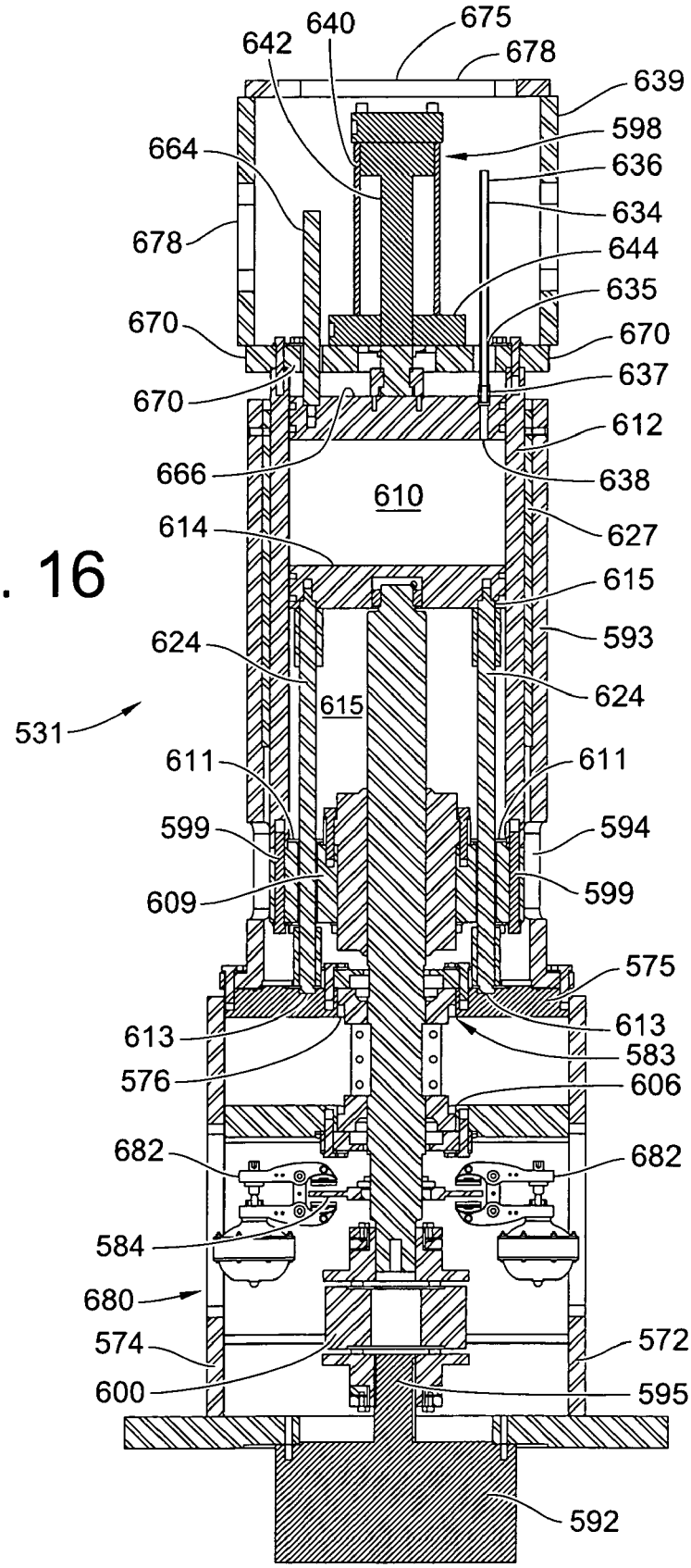
FIG. 16 is a cross-sectional illustration taken along lines 16-16 in FIG. 13, of the exemplary embodiment of the linear actuator shown in FIG. 12.

The movable piston 202 and volume adjusting actuator 208 may also be utilized for adjusting the axial length, or another operating parameter, of the linear actuator 200, for a given volume of the cavity 204 and amount of pressurized gas within the volume, in a manner described below in greater detail with respect to the alternate exemplary embodiment of the invention as illustrated in FIGS. 14-16. For example, by extending the linear actuator 200 in a manner which keeps the axial spacing between movable piston 202 and the fixed piston of the first cylinder element constant, as the extensible element 206 is advanced into the cavity 202 the axial length of the linear actuator 200 can be increased in an amount equal to the distance that the extensible element 206 is advanced, while keeping the same operating stroke and biasing force. In this manner, the axial length of the linear actuator 200 may be selectively varied to allow use of die sets having different vertical heights, for example, to thereby facilitate and expedite initial set-up and changing of set ups involving die sets having different heights.

In various embodiments of the invention, the volume adjusting actuator 208 may take any appropriate form, including, but not limited to, a hydraulic or pneumatic cylinder, or a mechanical actuator having a ball screw, roller screw, or any other appropriate mechanical drive apparatus connected to the extensible element 206.

FIG. 6 illustrates a version of the second exemplary embodiment of a linear actuator 200, according to the invention, in which two or more linear actuators 200 are controlled by a common controller 210 which is configured for controlling both the amount of pressurized gas introduced into the cavities 204 and the position of the movable piston 202 within the cavity 204. It will be understood, however, that in alternate embodiments of the invention, separate control arrangements may be utilized for controlling the amount of pressurized gas introduced into each of the cavities 204 and, likewise, separate control arrangements may be provided for controlling the volume adjusting actuators 208 of each of the linear actuators 200.

Figure 7:
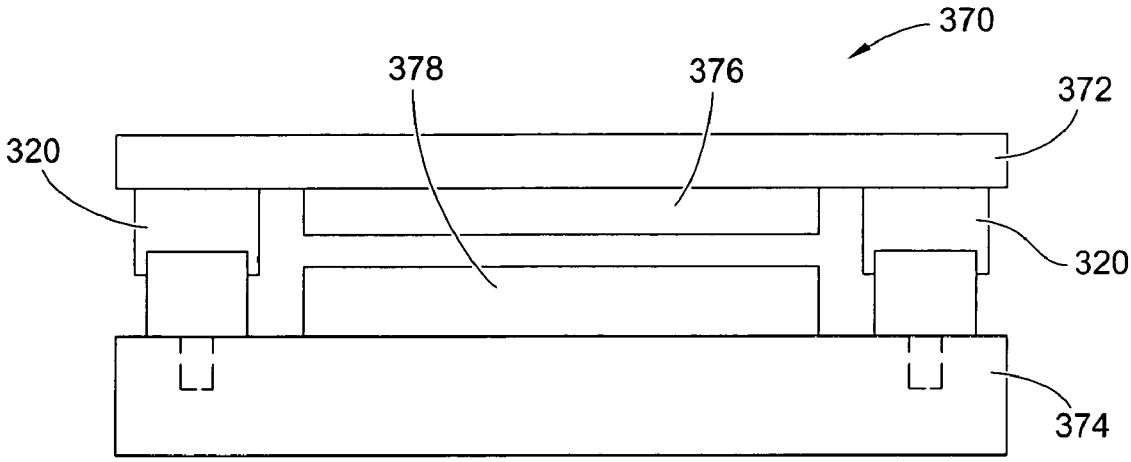
FIGS. 7 and 8 are side and end elevation views, respectively, of a press, according to the invention.
Figure 8:
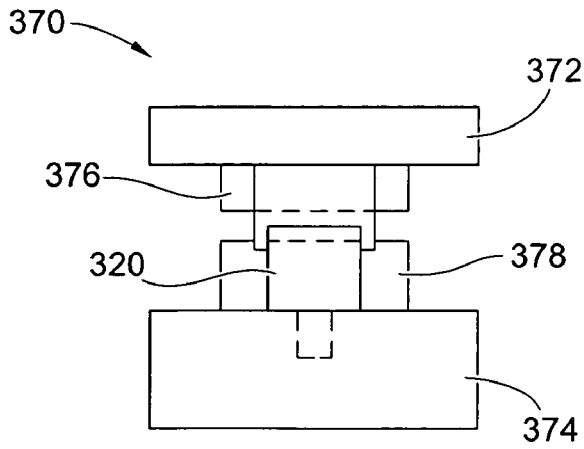

FIGS. 7 and 8 illustrate a third exemplary embodiment of the invention, in the form of a material forming machine, and more specifically in the form of a mechanical press 370 utilizing two pneumatically biased mechanical linear actuators 320, according to the invention. FIG. 8 shows an end view of the press 370, wherein the workpiece upon which the press 370 would be brought to bear would move into and out the press 370 along an axis into or out of the page. FIG. 7 shows a side view of the press 370, wherein the workpiece upon which the press would be brought to bear would move into and out of the press 370 along an axis going from side to side.

In both drawings, two pneumatically biasable linear actuators 320, according to the invention, and being preferentially biased for assisting extension of the linear actuators 320, in the manner described above with regard to the first and second exemplary embodiments 100, 200 of the invention, each have a first end thereof mounted to a first structure, in the form of a base 374 and a second end thereof connected to a second structure, in the form of a bridge 372.

The bridge 372 has a surface or "platen" designed to hold an upper die 376. The base 374 has a similar surface designed to hold a lower die 378. The press shown uses two linear actuators 320, but it should be understood that any number of actuators 320 could be used depending on the size of the bridge 372 and the forces required. Typically, there would be an even number of linear actuators 320. Also, for the preferred embodiment, a roller screw and roller nut are used for the mechanical drive arrangement of the linear actuators 320, to make advantageous use of the longer life provided by this type of drive arrangement. However, in some applications, a ball screw assembly or some other linear actuator may be preferred.

Figure 9:
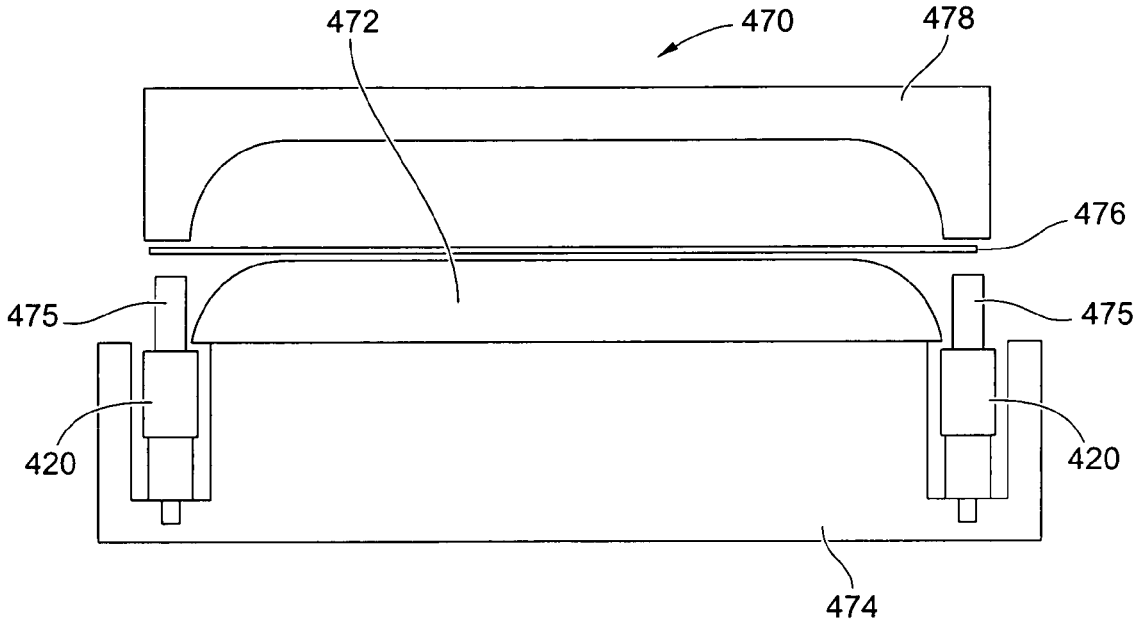
FIG. 9 is a side elevation view of a material forming machine, according to the invention, including a die cushion arrangement according to the invention.

FIG. 9 shows a fourth exemplary embodiment of the invention, in the form of a material forming machine, according to the invention, and more particularly, in the form of a die cushion arrangement 470, having two pneumatically biasable linear actuators 420, according to the invention, in the base of a press. In an actual installation, any number of pneumatically biasable linear actuators 420, according to the invention, may be utilized as die cushion mechanisms in such an application. For purposes of simplicity of illustration, only two linear actuators 420 are shown in FIG. 9.

The linear actuators 420 each has a first end thereof mounted to a base of the 474 of the press and a second, distal, end thereof coupled to a movable portion 475 of the lower die 472. The upper die 478 is designed to mate with the fixed portion of a lower die 472 to form the workpiece 476. The workpiece 476 is interposed and clamped between the upper die 478 and the movable portions 475 of the lower die 472 throughout the forming operation. The die cushion mechanism 470 shown uses two linear actuators 420, according to the invention, but it should be understood that any number of actuators 420 could be used depending on the number of movable portions 475 of the lower die 472, and the clamping forces required.

FIG. 9 shows the movable portions 475 of the lower die 472 as being mounted directly to the linear actuators 420, but in actual practice there are frequently pins interposed between the actuators 420 and the movable portions 475 of the lower die 472. Also, for the preferred embodiment, a roller screw and roller nut are used for the mechanical drive arrangement of the linear actuators 420, to make advantageous use of the longer life provided by this type of drive arrangement. However, in some applications, a ball screw assembly or some other linear actuator may be preferred.

In operation in a press, the upper die 478 is brought into contact with the workpiece 476. The linear actuator 420 may begin accelerating in a downward direction before the workpiece 476 contacts it. This "pre-acceleration" reduces the impact force on the workpiece 476, the dies 472, 478 and the press. As the upper die 478 is lowered further, the edges of the workpiece 476 are clamped between the upper die 478 and the movable portions 475 of the lower die 472. The clamping force exerted by the actuators 420 may be individually controlled during the forming cycle, to control the flow of the material within the dies 472, 478.

As the upper die 478 is lowered further still, the workpiece 476 is formed according to the clearance space between the die portions and the forces applied. As a result of the pressing operation, portions of the material of the workpiece are caused to stretch or flow within the clearance spaces. To properly control this flow of material within the dies 472, 478, the movable portions 475 of the lower die 472, must be pressed upward with the proper force by the linear actuators 420 as the upper die 478 continues its downward motion. After the upper die 478 has reached its lowest point, the motion of the upper die 478 is reversed and it is returned to its initial position. The linear actuators 420 may briefly continue the downward motion of the movable portions 475 of the lower die 472 to separate the formed workpiece 476 from the upper die 478, before moving the movable portions 475 of the lower die 472 upward to their initial position.

It is desired to use the pneumatically biasable mechanical linear actuators, according to the invention, in a die press mechanism, according to the invention, to thereby minimize the amount of power required from the motor of the actuators 420 and also for reducing the load on the mechanical drive arrangement of the actuators 420. By doing this, the size of the motor and roller screw mechanism may be minimized, while extending the life of the drive arrangement of the actuators 420.

Throughout most of the press cycle the linear actuators 420 must exert force in an upward direction. The amount of pressurized gas in the cavities of the pneumatic biasing arrangement, the initial volume of the cavity, and any surge tanks can be set to adjust the average force and the variation of forces provided by the pneumatics in order to reduce the peak and average load on the screw mechanism, in a manner taking into account factors such as, but not limited to, the desired forces for forming the workpiece 476, weights of components, and acceleration of machine components during operation of the die.

Figure 10:
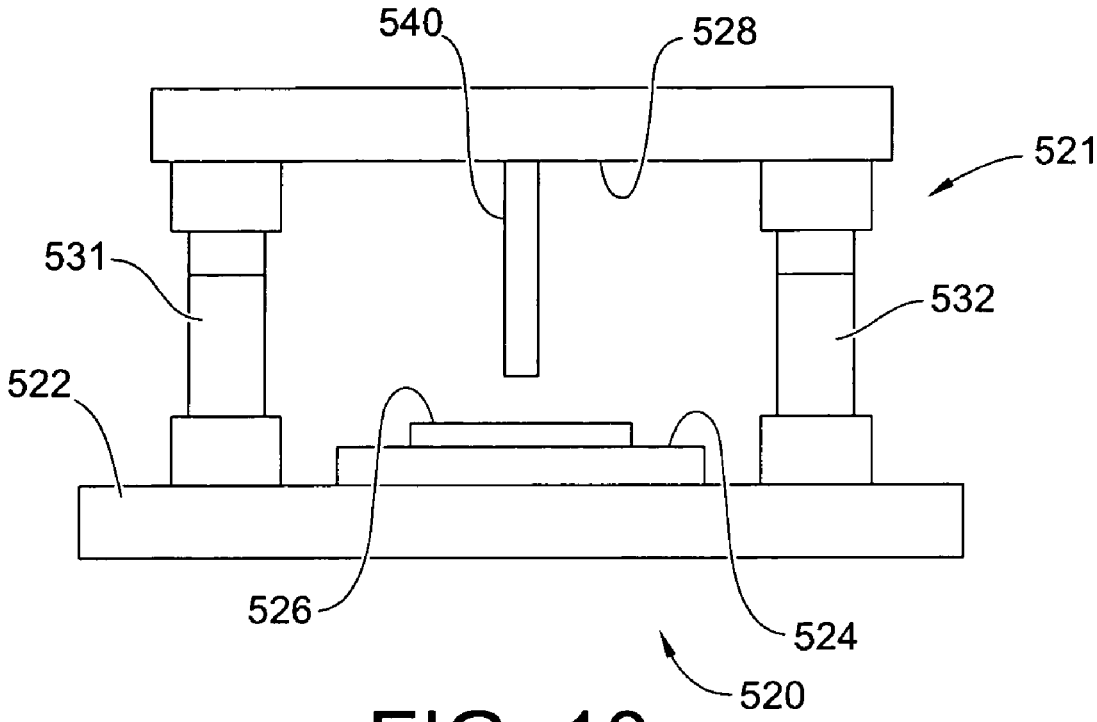
FIGS. 10 and 11 are a side elevation and top view, respectively, of a material forming machine, according to the invention, having a die set attached thereto for forming a workpiece.

FIG. 10 is a simplified representation of a fifth exemplary embodiment of the invention in the form of a material forming machine, and more specifically, in the form of a mechanical press 520 incorporating a pneumatically biasable mechanical linear actuator apparatus 521 according to the present invention. The mechanical press 520 includes a fixed base 522 on which is mounted a fixed platen 524 or bed for receiving a workpiece or stock material 526 to be processed by the mechanical press 520. The mechanical press 520 further includes a movable platen 528 supported above the base 522 by the pneumatically biasable mechanical linear actuator apparatus 521, according to the present invention, which provides vertical movement of the platen 528 relative to the fixed platen 524.

Figure 11:
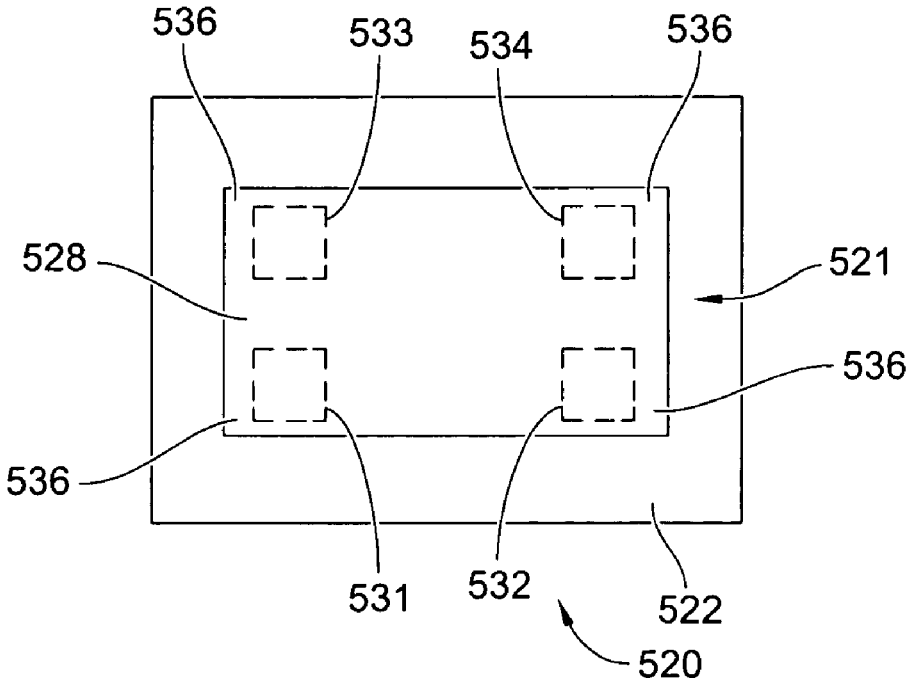

Referring also to FIG. 11, in accordance with the invention, the pneumatically biasable mechanical linear actuator apparatus 521 for the mechanical press 520 includes a plurality of pneumatically augmented linear actuators 531-534 which support the movable platen 528 in overlying relationship with the fixed platen 524 and provide relative vertical movement between the fixed and movable platens. In general, the linear actuators 531-534, of the fifth exemplary embodiment 520 of the invention, are functionally and structurally substantially identical to the linear actuator 200 of the second exemplary embodiment of the invention 200, described above in relation to the schematic illustrations of FIGS. 2 and 3.

Preferably, one of the linear actuators 531-534 is provided near each corner 536 of the mechanical press 520. The linear actuators 531-534 are oriented vertically and have their lower ends connected to the base 522 and their upper ends connected to the movable platen 528. The linear actuators 531-534 support the movable platen 528 in overlying relation with the fixed platen 524 and guide movement of the movable platen 528.

The pneumatically biased linear actuators 531-534, of the fifth exemplary embodiment of the invention, are described with reference to an application in a straight press machine of the type that is used to cut or form stock material 526 into predetermined length portions in a manner known in the art. In such application, the movable platen 528 carries a die 540 that can include one or more cutting blades or material forming tools. Although the die 540 is shown mounted in the center of the movable platen 528, the die can be carried by the movable platen at any location that allows cutting or forming of the stock material 526 located on the fixed platen. The fixed platen 524 can be mounted on a center portion of the base 522 and is adapted to receive stock material 526 to be cut or formed by the die 540.

As was the case for the other exemplary embodiments of pneumatically biased mechanical linear actuators 108, 200 described hereinabove, the linear actuators 531-534 of the fifth exemplary embodiment of the invention can be used in material forming machinery other than the straight press machine 520, such as swing shear presses, blanking shear presses, forming presses, and in die cushions, for example.

The pneumatically augmented linear actuators 531-534 are identical, and accordingly, only one linear actuator 531 is described in detail, with reference to FIGS. 12-16.

Figure 12:
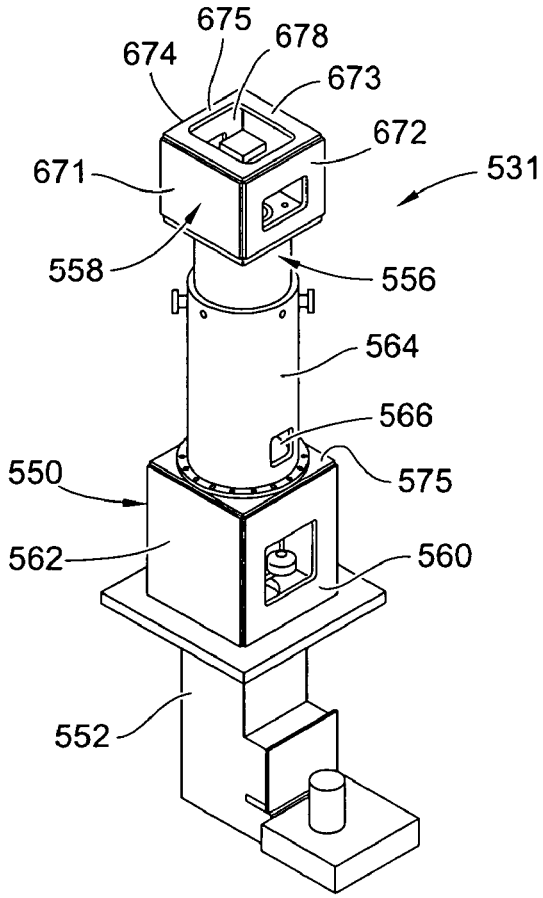
FIG. 12 is a perspective illustration of an alternate embodiment of a pneumatically biasable mechanical linear actuator, according to the invention.

FIG. 14, is a vertical section view of the linear actuator 531 of FIG. 12 taken along section line 14-14. In FIG. 14, the linear actuator 531 is shown at an at rest or home position which corresponds to the beginning of a down stroke.

The linear actuator 531 includes a actuator support structure 550, including a support pedestal 562, and a cylinder guide 564, supporting a drive arrangement, in the form of a roller screw mechanism 554, and a pneumatic biasing arrangement 556 which is connected at an upper end 622 thereof to movable bridge 558.

The cylinder guide 564 is attached at its lower end 560 to the top of the pedestal 562. The pedestal 562 is generally rectangular in shape and includes four sides 571-574 (FIG. 13) and a top 575. The sides 571-574 form a box-like structure, the upper end of which is closed by the top 575. The top 575 is generally rectangular in shape and is secured to the sides 571-574. The top 575 has a central aperture 576 in which is mounted a thrust bearing and seal assembly 583 for a screw member 593 of the roller screw mechanism 554.

The lower end of the pedestal 562 terminates in an actuator mounting plate 580 which is generally rectangular in shape. The actuator mounting plate 580 has a central aperture 582 that is aligned axially with the aperture 576 in the top 575. As will be shown, the screw member 593 is coupled to a drive motor 592, the shaft 595 of which extends through the aperture 582. The pedestal 562 contains an intermediate plate 584 including a central aperture 585 that is aligned axially with apertures 576 and 582 and in which is mounted a further thrust bearing and seal assembly 606 for the screw member 593.

The cylinder guide 564 is a hollow tubular member that is supported on and fixed to the top 575 of the pedestal 562. The sidewall of the cylinder guide 564 has diametrically opposed access openings 566 near the lower end 578 of the cylinder guide 564.

Referring to FIGS. 10 and 11, the pedestal 552 is adapted for mounting the linear actuator 531 to the base 522 of the mechanical press 520. The upper end of the linear actuator 531 is adapted for attachment to the movable bridge 558, with the movable bridge 558, in turn, being adapted for coupling the upper ends of the linear actuators 531-534 collectively to the movable platen 528.

Figure 13:
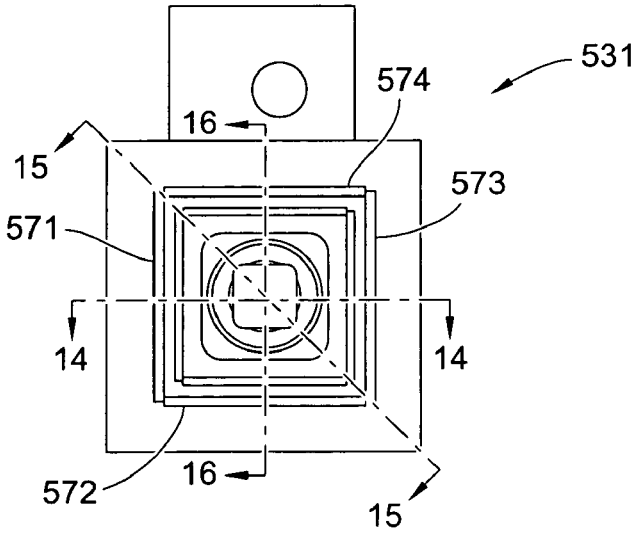
FIG. 13 is a top view of the exemplary embodiment of a linear actuator of FIG. 12, having indicated thereupon section lines relating to FIGS. 14-16.

Reference is now made to FIGS. 14-16, which are vertical section views (taken alone lines 14-14, 15-15, and 16-16, as shown in FIG. 13, of the linear actuator 531. FIG. 15 illustrates the condition of the linear actuator 531 in a fully extended condition corresponding to the beginning and end of a down stroke cycle of the movable platen 528. FIG. 16 illustrates the linear actuator 531 in a fully retracted condition corresponding to the lowermost movement of the movable platen 528 at approximately the mid-point of a down stroke cycle of the movable platen 528.

The roller screw mechanism 554, of the linear actuator 531, includes a driving member, in form of the screw member 593, and a driven member in the form of a roller screw nut member 594. The screw member 593 is rotatably driven directly by the drive shaft 595 of the drive motor 592. The roller screw nut member 594 is operatively connected to the screw member 593, and to a disc 609 at the lower end 578 of an axially movable cylinder 612 of the pneumatic biasing arrangement 556, such that rotary motion of the motor shaft 595 is converted into linear motion of the roller screw nut 594 and the axially movable cylinder 612, in substantially the same manner as described above in relation to the linear actuators 108, 200 of the first and second exemplary embodiments 100, 200 of the invention.

The screw member 593 is supported vertically within the cylinder guide 564. The lower end 601 of the screw member 593 projects into the pedestal 562 and is coupled to the shaft 595 of the drive motor 592 through a coupling mechanism 600. The upper end 602 of the screw member 593 is journalled in a recess 603 in a lower surface 604 of a fixed piston 614 of a first cylinder structure, of the pneumatic biasing arrangement 556, formed collectively by the fixed piston 614, a pair of guide posts 624, and the top 575 of the support pedestal 562. The screw member 593 is supported intermediate the upper axial end 602 and the lower end 601 of the screw member 593 by the bearing and seal assemblies 583 and 606.

The drive motor 592 is mounted within the pedestal 552 with the shaft 595 of the drive motor 592 extending through the aperture 582 in the actuator mounting plate 580 into the lower end of the pedestal 562, allowing the shaft 595 to be coupled to the screw member 593 by the coupling mechanism 600.

The roller screw nut member 594 is enclosed within the cylinder guide 564. The roller screw nut member 594 is threadedly engaged by the screw member 593 and is movable vertically relative to the cylinder guide 564 in response to rotation of the screw member 593 by the drive motor 592. The roller screw nut member 594 is coupled by a disk 609 to an axially movable cylinder 612 of the pneumatic component 596. The roller screw nut member 594 is connected to the disk 609 by a plurality of screws 597 (FIG. 15). The disk 609 is connected to the bottom of the axially movable cylinder 612 by a plurality of screws 599. The disk 609 and the axially movable cylinder 612 are translatable vertically up and down by the roller screw mechanism 554 to produce vertical reciprocating motion for the movable platen 528 as will be shown.

Referring to FIGS. 14-16, a pair of guide posts 624 are provided for guiding the disk 609 as it is moved vertically up and down. The disk 609 has through-bores 611 through which the guide posts 624 extend. The lower ends 613 of the guide posts 624 are mounted in the top 575 of the pedestal 562. The upper ends 615 of the guide posts 624 are secured in apertures 617 in the lower surface 619 of the fixed piston 614. The guide posts 624 provide vertical guidance for the disk 609 and the axially movable cylinder 612 carried by the disk 609, and thus for the movable bridge 558 and the movable platen 528 which are supported on the axially movable cylinder 612. The upper and lower ends of the guide posts 624 carry positive upper stops 623 (FIG. 15) and lower stops 625 (FIG. 15), respectively, which define end of travel positions for the roller screw nut member 594.

Referring to FIGS. 15 and 16, the pneumatic biasing arrangement 556 includes the axially movable cylinder 612, the fixed piston 614 and a movable piston 616. The fixed piston 614 is located within the axially movable cylinder 612 and is fixed to and supported by the screw member 593 to be located near the center portion of the axially movable cylinder 612. The fixed piston 614 closes the lower portion axially movable cylinder 612 which is movable vertically relative to the fixed piston 614 and the cylinder guide 564. There is a sleeve bushing 627 interposed between the outer surface of the axially movable cylinder 612 and the inner surface of the cylinder guide 564. The concentric axially movable cylinder 612 and cylinder guide 564 provide a sliding joint and function as guide mechanism of the linear actuators 531-534 for maintaining parallelism for the press 520.

The fixed piston 614 includes peripheral seals 626 that are located in annular grooves on the periphery of the fixed piston 614.

Referring to FIG. 16, the axially movable cylinder 612, the fixed piston 614 and the movable piston 616 form a closed, pressurized air chamber 610. As will be shown, pressurized air is introduced into the air chamber 610 to produce to offset force for use in returning the movable platen 528 to the home position during the up stroke of an operating cycle.

The pneumatic biasing arrangement 556 includes a fill tube 634 (FIG. 16) to allow pressurized gas to be introduced into the pressurized chamber 610. The fill tube 634 is normally sealed, in embodiments of the invention where a fixed precharge of pressurized gas is utilized, and is replaced with a connection to a control arrangement(not shown) in embodiments of the invention where the pressure in the cavity 610 is actively controlled. The fill tube 634 extends through an aperture 635 in a base 670 of the movable bridge 558.

As shown in FIG. 12, the movable bridge 558 is a generally rectangular structure including the base 670, four sides 671-674 and a top 675. The base 670 is secured to the upper end of the axially movable cylinder 612 by a plurality of screws 676. The top 675 and at least opposite sides 672 and 674 include access openings, such as access opening 678 in the top 675. The top 675 is adapted to be connected to the movable platen 528.

The lower end 637 of the fill tube 634 is seated in a throughbore 638 of a volume adjustment piston 616, described in more detail below, for communicating the interior of the fill tube 634 with the interior of the pressurized chamber 610. The fill port 636 defined by the upper end of the fill tube 634 is located near the upper end 639 of the movable bridge 558, providing access to the fill tube 634 through the access opening 678 for introducing pressurized gas into the pressurized air chamber 610.

In some embodiments of the invention, the cavity 610 contains an amount of pressurized gas sufficient to impose a unidirectional biasing force between the roller screw nut 594 and the screw member 593 of the roller screw mechanism 554. Two parameters, the pressure within the cavity 610 and the volume height of the cavity 610, are adjusted to provide the desired functionality for the pneumatic biasing arrangement 556. The pressure within the cavity 610 decreases over the length of the extension stroke of the linear actuator 531. The volume of the cavity 610 determines how large the change in pressure is from the top to the bottom of a stroke.

The pneumatic biasing arrangement 556 is adjustable to allow the mechanical press 520 to be set up for processing workpieces of different sizes and to provide different processing functions (cutting, forming, etc.) as is known. The pressure and volume height are set at the values needed to cause the die 540 to properly interact with the workpiece 526 during operating cycles of the mechanical press 520.

While in the exemplary embodiment 531, the size of the cavity 610 is adjusted using a hydraulic mechanism, the size of the cavity 610 can be adjusted in other ways, such as through the use of binary volume arrangement in which a plurality of external are selectively communicated with the interior of the cavity 610.

The pressure within the cavity 610 is selected to produce an upwardly directed force for causing the roller screw nut member 594 to be maintained in engagement with the screw member 593 at the same side of the screw thread of the screw actuator on the upstroke following reversal, thereby minimizing wear on the screw actuator. Stated in another way, the roller screw nut member 594 is pulled up due to the unidirectional biasing force generated by the pneumatic biasing arrangement 556, in the same manner as described above in relation to the actuator 200 of the second exemplary embodiment shown in FIG. 4. This results in reduction on force applied to the screw member 593 and roller screw nut 594, thereby extending the life of the roller screw mechanism 254. In addition, this allows reduction in the size of the screw member 593 and in the size of the drive motor 592 and the overall size of the pneumatically biasable mechanical linear actuator apparatus 521.

Referring to FIGS. 14 and 15, the linear actuator 531 also includes a pressure cavity volume adjustment arrangement 598. The pressure cavity volume adjustment arrangement 598 includes a movable volume adjustment piston 616, and a volume adjustment actuator, in the form of a hydraulic cylinder 640 and a hydraulic piston 642 located within the hydraulic cylinder 640 for slidable movement along the inner wall of the hydraulic cylinder 640. The adjustment arrangement 598 is disposed in-line with the components of the pneumatic biasing arrangement 556, and with the screw member 593. The adjustment arrangement 598 is enclosed within the movable bridge 558.

Referring to FIGS. 14 and 15, the hydraulic cylinder 640 includes a tubular member having a lower end 643 closed by a bottom member 644 and an upper end 645 closed by a top member 646. The bottom member 644 has an aperture 648 through which extends the rod end 650 of the hydraulic piston 642.

Referring to FIGS. 15 and 16, the hydraulic piston 640 has a piston head 652 that is located within the hydraulic cylinder 640. The rod end 650 of the hydraulic piston 642 extends through aligned apertures 648 and 656 in the bottom member 644 of the hydraulic cylinder 642 and in the base 670 of the movable bridge 558, respectively. The rod end 650 is connected to the movable piston 616 by a collar 660 (FIG. 15) that traps an enlarged end portion 662 of the piston rod 660. A post 664 indexes the movable bridge 558 to the movable piston 616 of the pneumatic component 596.

The movable piston 616 is located within the axially movable cylinder 612, of the pneumatic biasing arrangement 556, near the upper portion of the axially movable cylinder 612 for slidable movement along the inner wall of the axially movable cylinder 612. The movable piston 616 closes the upper end of the axially movable cylinder 612, and, in combination with the fixed piston 614 and the portion of the inner surface of the axially movable cylinder 612 between the fixed piston 614 and the volume adjusting piston 616, defines the volume within the cavity 610 available for receiving pressurized gas. The volume adjusting piston 616 is movable relative to the axially movable cylinder 612. The axis of the movable piston 616 extends coaxially with the axis of the screw member 593. Peripheral seals 630 are located in annular grooves on the periphery of the movable piston 616, for slidingly sealing the juncture of the piston 616 with the axially movable cylinder 612.

The volume adjusting piston 616 is moved axially up or down (when the actuator 531 is oriented as shown in 14 and 15) to provide an additional mechanism for conveniently adjusting the working volume of the cavity 610, and thereby facilitate set up and use of the linear actuator 321, of the fifth exemplary embodiment of the invention, when the operating load and/or operating force conditions, or the operating stroke of the actuator 531 change significantly.

As will be understood from a comparison of FIGS. 14 and 15, which both show the movable piston 616 spaced the same axial distance from the fixed piston 614, to thereby provide the same volume in the cavity 610, the movable piston 616 of the cavity volume and minimum actuator length adjustment arrangement 598 may also be utilized for adjusting other operating parameters of the actuator 531, such as, but not limited to, for example: adjusting the relationship between the stroke length, and/or stoke direction, of the linear actuator 531, and the change in pressure within the cavity 610 resulting from the stroke; adjusting the axial length of the linear actuator 531; setting maximum and/or minimum operating pressures for the pressurized gas within the cavity 610; and/or, setting a desired maximum or minimum magnitude of the unidirectional biasing force.

By operating the motor 592, to advance the roller screw nut 594 in a manner which keeps the axial spacing between movable piston 616 and the fixed piston 614 constant, as the extensible piston 642 of the adjustment arrangement 598 is advanced into the cavity 610, the fully retracted length of the linear actuator 531 can be increased in an amount equal to the distance that the piston 642 is advanced into the cavity 610, while keeping the same operating stroke and biasing force. In this manner, the length of the linear actuator 200 may be selectively varied to allow use of die sets having different vertical heights, or for stroking in an opposite direction, for example, to thereby facilitate and expedite initial set-up and changing of set ups involving die sets having different heights. In FIG. 14, the actuator 14 is set up for use in a downward stroke, from the rest position shown in FIG. 14, and in FIG. 15, the actuator 15 is set up for an up stroke, from the rest position shown in FIG. 15, with the volume of the cavity 610 being substantially the same in both set ups of the actuator 531.

Referring to FIG. 16, the linear actuator 531 includes a braking mechanism 680 for holding the screw member 593. Preferably, the brakes are spring-applied, pneumatic-release brakes used to hold position and provide for emergency stopping. The brakes 680 are located within the pedestal 562, in the exemplary embodiment of the linear actuator 531, but could be located elsewhere in other embodiments of the invention. The brakes 680, in the exemplary embodiment 532, are caliper-type brakes including spring loaded calipers 682 which engage a brake disk 684 that extends outward radially from the screw member 593. The calipers 682 are actuated pneumatically to release the screw member 593 for rotation by the drive motor 592.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pneumatically biasable mechanical linear actuator apparatus, for exerting a bidirectional force along an axis of motion between a first structure and a second structure, wherein at least one of the structures is movable along the axis of motion, the linear actuator apparatus comprising, at least one pneumatically biasable linear actuator having:

a driving and a driven member connected to one another in a mechanical drive arrangement for motion relative to one another along the axis of motion; and a pneumatic biasing arrangement operatively connected between the driving member and the driven member for applying a unidirectional biasing force between the driving and driven members, along the axis of motion, regardless of the location or movement of the driving and driven elements with respect to one another along the axis of motion; and a volume adjusting element movably disposed within the fluid cavity for modifying the volume available for receiving pressurized fluid in the cavity;

the pneumatic biasing arrangement comprising, first and second pneumatic cylinder elements connected to one another for reciprocal movement with respect to one another along the axis of motion and collectively defining a fluid cavity therebetween defining a volume for receiving a pressurized fluid, the first cylinder element being fixedly attached to the driving member for movement therewith along the axis of motion, and the second cylinder element being fixedly attached to the driven member for movement therewith, such that relative movement of the driven and driving members with respect to one another in one direction along the axis of motion causes an increase in the volume of the cavity and movement of the driven and driving members with respect to one another in an opposite direction along the axis of motion causes a decrease in the volume of the cavity.

2. The apparatus of claim 1, further comprising, a control arrangement operatively connected to the pneumatic biasing arrangement for controlling the unidirectional biasing force.

3. The apparatus of claim 1, further comprising, a control arrangement for controlling the amount of pressurized gas in the volume.

4. The apparatus of claim 3, wherein, the control arrangement adjusts the amount of pressurized gas in the volume to maintain a desired level of unidirectional biasing force.

5. The apparatus of claim 3, further comprising, at least two linear actuators and a common control arrangement for controlling the amount of pressurized gas in the volumes of each of the at least two linear actuators.

6. The apparatus of claim 1, wherein, the driving and driven members and the first and second cylinder elements are all coaxially disposed along the axis of motion.

7. The apparatus of claim 1, further comprising, an amount of pressurized gas disposed within the volume of the pneumatic biasing arrangement sufficient for generating the unidirectional biasing force between the driving and driven members.

8. The apparatus of claim 7, wherein, application of driving force to the driving member generates a driving force in the driven member, and the amount of pressurized gas generates sufficient pressure within the cavity for maintaining the unidirectional biasing force between the driving and driven members regardless of the direction or level of the driving force.

9. The apparatus of claim 8, wherein, the first and second structures apply an operating load to the actuator, and the amount of pressurized gas in the cavity generates sufficient pressure within the cavity for maintaining the unidirectional biasing force between the driving and driven members regardless of the direction or level of the operating load on the actuator, and regardless of relative position or motion of the first and second structures with respect to one another.

10. The apparatus of claim 9, further comprising, a control arrangement for controlling the amount of pressurized gas in the volume.

11. The apparatus of claim 10, wherein, the control arrangement adjusts the amount of pressurized gas in the volume to maintain a desired level of unidirectional biasing force.

12. The apparatus of claim 11, further comprising, at least two linear actuators and a common control arrangement for controlling the amount of pressurized gas in the volumes of each of the at least two linear actuators.

13. A pneumatically biasable mechanical linear actuator apparatus, for exerting a bidirectional force along an axis of motion between a first structure and a second structure, wherein at least one of the structures is movable along the axis of motion, the linear actuator apparatus comprising, at least one pneumatically biasable linear actuator having:

a driving and a driven member connected to one another in a mechanical drive arrangement for motion relative to one another along the axis of motion; and a pneumatic biasing arrangement operatively connected between the driving member and the driven member for applying a unidirectional biasing force between the driving and driven members, along the axis of motion, regardless of the location or movement of the driving and driven elements with respect to one another along the axis of motion; and the pneumatic biasing arrangement comprising, first and second pneumatic cylinder elements connected to one another for reciprocal movement with respect to one another along the axis of motion and collectively defining a fluid cavity therebetween defining a volume for receiving a pressurized fluid, the first cylinder element being fixedly attached to the driving member for movement therewith along the axis of motion, and the second cylinder element being fixedly attached to the driven member for movement therewith, such that relative movement of the driven and driving members with respect to one another in one direction along the axis of motion causes an increase in the volume of the cavity and movement of the driven and driving members with respect to one another in an opposite direction along the axis of motion causes a decrease in the volume of the cavity;

the driving and driven members respectively being a rotatable screw member and a roller nut member of a roller screw apparatus, with the screw having a rotational centerline thereof substantially defining the axis of motion and first and second axial ends thereof spaced axially from one another along the axis of motion, and the roller screw nut member having rotating inner members for engaging the screw, with the rotating inner members being operatively attached to and disposed within a non-rotating roller screw nut housing;

the first cylinder element of the pneumatic biasing arrangement being disposed about the axis of motion and having the screw member operatively attached thereto in a manner allowing rotation of the screw with respect to the first cylinder member about the axis of rotation and axially restraining the screw against axial movement of the screw with respect to the first cylinder member;

the first cylinder element, further having first and second axial ends thereof, with the first axial end of the first cylinder member being disposed adjacent the first axial end of the screw and the second axial end of the first cylinder member being disposed adjacent the second axial end of the screw, the second axial end of the first cylinder member also being configured as a closed surface to form a stationary piston having an outer sealing periphery thereof;

the second cylindrical element, in the form of an axially movable cylinder, having a wall thereof sealingly and slidingly engaging the sealing periphery of the stationary piston of the first cylinder member such that the wall of the movable cylinder in conjunction with the stationary piston of the first cylinder member form the cavity and define the volume for receiving the pressurized gas;

the second cylindrical element, in the form of the axially movable cylinder, being operatively attached to the first cylindrical element, in a manner allowing the second cylindrical element to move axially with respect to the first cylindrical element, but not rotate with respect to the first cylindrical element or the axis of motion;

the second cylindrical element, in the form of the axially movable cylinder, also having first and second axial ends thereof, with the first axial end overlapping the first cylinder member and having the roller screw housing fixedly attached thereto in such a manner that the roller screw nut moves axially with the movable cylinder, and the second axial end of the movable cylinder being closed;

the first cylindrical element being adapted for operatively bearing against a stationary one of the first and second structures and the second cylindrical element being adapted for operatively bearing against the movable one of the first and second structures.

14. The apparatus of claim 13, further comprising, a guide extending from the first cylindrical element along the axis of motion and disposed about a portion of the second cylindrical member for guiding and supporting the second cylindrical element axially about the axis of motion.

15. The apparatus of claim 13, further comprising, a drive motor operatively attached to the first end of the screw for rotating the screw about the axis of rotation.

16. The apparatus of claim 13, further comprising, a brake for selectively restraining the screw from rotating about the axis of rotation.

17. The apparatus of claim 13, wherein, the axis of motion extends substantially vertically between the first and second structures.

18. A material forming machine comprising:

a first structure and a second structure, wherein at least one of the structures is movable along an axis of motion; and at least one pneumatically biasable linear actuator apparatus operatively connecting the first and second structures for exerting a bidirectional force along the axis of motion between the first structure and a second structure;

the linear actuator having a driving and a driven member connected to one another in a mechanical drive arrangement for motion relative to one another long the axis of motion;

the linear actuator further having a pneumatic biasing arrangement operatively connected between the driving member and the driven member for applying a unidirectional biasing force between the driving and driven members, along the axis of motion, regardless of the location or movement of the driving and driven elements with respect to one another along the axis of motion;

the pneumatic biasing arrangement having, first and second pneumatic cylinder elements connected to one another for reciprocal movement with respect to one another along the axis of motion and collectively defining a fluid cavity therebetween defining a volume for receiving a pressurized fluid, the first cylinder element being fixedly attached to the driving member for movement therewith along the axis of motion, and the second cylinder element being fixedly attached to the driven member for movement therewith, such that relative movement of the driven and driving members with respect to one another in one direction along the axis of motion causes an increase in the volume of the cavity and movement of the driven and driving members with respect to one another in an opposite direction along the axis of motion causes a decrease in the volume of the cavity;

the driving and driven member being respectively a rotatable screw member and a roller nut member of a roller screw apparatus, with the screw having a rotational centerline thereof substantially defining the axis of motion and first and second axial ends thereof spaced axially from one another along the axis of motion, and the roller screw nut member having rotating inner members for engaging the screw, with the rotating inner members being operatively attached to and disposed within a non-rotating roller screw nut housing;

the first cylinder element of the pneumatic biasing arrangement being disposed about the axis of motion and having the screw member operatively attached thereto in a manner allowing rotation of the screw with respect to the first cylinder member about the axis of rotation and axially restraining the screw against axial movement of the screw with respect to the first cylinder member;

the first cylinder element, further having first and second axial ends thereof, with the first axial end of the first cylinder member being disposed adjacent the first axial end of the screw and the second axial end of the first cylinder member being disposed adjacent the second axial end of the screw, the second axial end of the first cylinder member also being configured as a closed surface to form a stationary piston having an outer sealing periphery thereof;

the second cylindrical element, in the form of an axially movable cylinder, having a wall thereof sealingly and slidingly engaging the sealing periphery of the stationary piston of the first cylinder member such that the wall of the movable cylinder in conjunction with the stationary piston of the first cylinder member form the cavity and define the volume for receiving the pressurized gas;

the second cylindrical element, in the form of the axially movable cylinder, is operatively attached to the first cylindrical element, in a manner allowing the second cylindrical element to move axially with respect to the first cylindrical element, but not rotate with respect to the first cylindrical element or the axis of motion;

the second cylindrical element, in the form of the axially movable cylinder, also having first and second axial ends thereof, with the first axial end overlapping the first cylinder member and having the roller screw housing fixedly attached thereto in such a manner that the roller screw nut moves axially with the movable cylinder, and the second axial end of the movable cylinder being closed;

the first cylindrical element being adapted for operatively bearing against a stationary one of the first and second structures and the second cylindrical element being adapted for operatively bearing against the movable one of the first and second structures.

* * * * *